US011126121B2

(12) United States Patent
Nihonyanagi et al.

(10) Patent No.: US 11,126,121 B2
(45) Date of Patent: Sep. 21, 2021

(54) IMAGE FORMING APPARATUS AND IMAGE FORMING SYSTEM THAT SET CONVEYING SPEED BASED ON A NUMBER OF SMALL SHEETS TO BE USED OR A PRINT OPERATION HISTORY

(71) Applicant: CANON KABUSHIKI KAISHA, Tokyo (JP)

(72) Inventors: Koji Nihonyanagi, Susono (JP); Masato Sako, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/943,200

(22) Filed: Jul. 30, 2020

(65) Prior Publication Data

US 2021/0034001 A1 Feb. 4, 2021

(30) Foreign Application Priority Data

Jul. 30, 2019 (JP) ..... JP2019-139599
Jun. 23, 2020 (JP) ..... JP2020-107990

(51) Int. Cl.
*G03G 15/00* (2006.01)
*G03G 15/20* (2006.01)

(52) U.S. Cl.
CPC ..... *G03G 15/50* (2013.01); *G03G 15/2039* (2013.01); *G03G 15/2064* (2013.01)

(58) Field of Classification Search
USPC ..... 399/68
See application file for complete search history.

(56) References Cited

U.S. PATENT DOCUMENTS 6,285,838 B1 * 9/2001 Able ..... G03G 15/2003 399/45
2009/0190941 A1 * 7/2009 Hashimoto ..... G03G 15/2028 399/43
2012/0033987 A1 * 2/2012 Ikegami ..... G03G 15/5029 399/82

(Continued)

FOREIGN PATENT DOCUMENTS

JP 07199694 A 8/1995
JP 11-024493 A 1/1999

(Continued)

OTHER PUBLICATIONS

Co-pending U.S. Appl. No. 16/943,193, filed Jul. 30, 2020.

*Primary Examiner* — Quana Grainger
(74) *Attorney, Agent, or Firm* — Venable LLP

(57) ABSTRACT

An image forming apparatus, including: a control portion that controls a conveying speed of recording materials when the recording materials pass through a nip portion; wherein the control portion, in a case of continuous sheet passing of the recording materials each having a smaller width than the recording materials each having a maximum width: executes, in a case where a representative value of the number of the recording materials having the smaller width for one operation of the continuous sheet passing is smaller than a predetermined threshold, a first operating mode in which the conveying speed is controlled to a first speed; and executes, in a case where the representative value is the threshold or more, a second operating mode in which the conveying speed is controlled to a second speed lower than the first speed.

28 Claims, 13 Drawing Sheets

(56) References Cited

U.S. PATENT DOCUMENTS

| | | | | |
|---|---|---|---|---|
| 2012/0192378 | A1* | 8/2012 | Bassett | A47L 9/1666 15/353 |
| 2013/0259507 | A1* | 10/2013 | Cao | G03G 15/2042 399/69 |
| 2017/0168444 | A1* | 6/2017 | Kobayashi | G03G 15/2028 |
| 2017/0192378 | A1* | 7/2017 | Hashiguchi | G03G 15/2039 |

FOREIGN PATENT DOCUMENTS

| | | | |
|---|---|---|---|
| JP | 2003-050519 | A | 2/2003 |
| JP | 2011-033713 | A | 2/2011 |
| JP | 5455493 | B2 | 3/2014 |
| JP | 2014-199409 | A | 10/2014 |

* cited by examiner

IMAGE FORMING APPARATUS AND IMAGE FORMING SYSTEM THAT SET CONVEYING SPEED BASED ON A NUMBER OF SMALL SHEETS TO BE USED OR A PRINT OPERATION HISTORY

BACKGROUND OF THE INVENTION

Field of the Invention

The present invention relates to an electrophotographic image forming apparatus, such as a copying machine or printer, which includes an image heating apparatus and forms images on recording materials, and to the enhancement of the throughput of small size sheets.

Description of the Related Art

Hitherto, in order to control a non-sheet-passage-part temperature rise that can occur in a film fixing device that is used in an electrophotographic image forming apparatus to be a desired value or less, the following technologies have been proposed. For example, in Japanese Patent Application Laid-open No. H07-199694, the throughput (productivity) is changed depending on recording material widths. When a recording material has a small width, the throughput is reduced (the sheet feeding interval is increased) so that a temperature of a non-sheet-passage part does not rise excessively.

Further, for example, Japanese Patent Application Laid-open No. 2003-50519 proposes an image forming apparatus configured to change the image forming speed depending on recording material widths instead of changing the throughput by changing the sheet feeding interval depending on recording material widths. Japanese Patent Application Laid-open No. 2003-50519 employs two types of image forming speeds (mm/sec), namely, 200 mm/sec and 100 mm/sec.

For recording materials having a large width (hereinafter referred to as "large size sheet"), such as A4, letter, or legal size recording materials, a sheet interval (a distance between the trailing end portion of an N-th page and the leading end portion of an (N+1)-th page when the sheets are fed continuously) is 65 mm. Then, the throughput of the A4 size is 33 sheets/min, the throughput of the letter size is 34.8 sheets/min, and the throughput of the legal size is 28.5 sheets/min. Here, the numerical value of the sheet interval of 65 mm is the minimum sheet interval that the image forming apparatus can take, and means the minimum sheet interval amount that can be compensated for with variations in sheet feeding timing, variations in response timing of sensors in the conveyance path, or the like. Meanwhile, recording materials having a small width (hereinafter referred to as "small size sheet"), such as B5, A5, or executive size recording materials are set as one group. For the recording materials having a small width, the image forming speed is set to 100 mm/sec, which is half of the one for large size sheets, so that the throughput is controlled to achieve the sheet interval of 65 mm. As a result, the throughput of the B5, A5, and executive sizes is 18 sheets/min. Since the amount of heat necessary for fixing is small when an image forming speed is low, a fixing film is set to a low temperature so that a non-sheet-passage-part temperature rise can consequently be prevented.

Further, for example, Japanese Patent No. 5455493 proposes the following: in an image forming apparatus having a plurality of image forming speeds, in a case where small size sheets are printed, the image forming speed is switched depending on the number of prints, and images are formed. In this case, when a small number of sheets are to be printed, since a non-sheet-passage-part temperature rise is not likely to exceed a desired value, printing is performed at the highest image forming speed. Meanwhile, when a large number of sheets are to be printed, printing is performed at a low image forming speed to prevent a non-sheet-passage-part temperature rise.

SUMMARY OF THE INVENTION

However, in Japanese Patent Application Laid-open No. H07-199694, the throughput differs between large size sheets and small size sheets. As a result of an increase in image forming speed along with an increase in speed of the image forming apparatus, only the throughput of large size sheets is enhanced, and the throughput of small size sheets is not enhanced. Further, since the sheet interval is increased when the throughput drops, a cartridge of an image forming portion is rotated for a long time in the printing of a predetermined number of sheets, with the result that the life is shortened. Further, since it is necessary to increase the sheet interval to reduce the throughput from around the beginning to deal with a non-sheet-passage-part temperature rise, the total productivity (average throughput) of the printing of a large number of sheets is low.

Further, in Japanese Patent Application Laid-open No. 2003-50519, the image forming speed is fixed on the basis of recording material widths, and the image forming speed for small size sheets is always low, with the result that the throughput drops. Thus, even in the printing of a small number of sheets, in which the effect of a non-sheet-passage-part temperature rise is small, the throughput drops.

Further, in Japanese Patent No. 5455493, an optimal image forming speed is selected depending on the number of prints, but the number of prints is not always known when image forming operation starts. That is, in the case of a printer, the number of prints is grasped after an image controller portion configured to convert image information transmitted from a host computer into printable information finishes the conversion of all the image information. Thus, in a case where a large number of sheets are to be printed, if the processing waits until the number of prints is grasped, it takes a long time for the printer to start printing, resulting in an increase in time until the output of the first sheet (First Print Out Time: FPOT). Thus, in a case where a shorter FPOT is desired, image forming operation starts at a time point at which the image controller portion processes the image information on the first sheet, and hence the number of remaining print sheets is not always grasped.

Further, also in the case of a copying machine, image forming operation starts at a time point at which the first sheet is read out by an image read out apparatus, and hence the number of remaining print copies is not always grasped.

An object of the present invention is to provide a technology capable of enhancing productivity irrespective of recording material size and extending the life of the apparatus.

In order to achieve the object described above, an image forming apparatus including:

an image forming portion that forms an image on a recording material;

a fixing portion including a nip portion that nips and conveys the recording material, the fixing portion heating the image at the nip portion to fix the image onto the recording material;

a storage portion that at least stores, relative to recording materials each having a smaller width than recording materials each having a maximum width in a direction orthogonal to a conveying direction among recording materials conveyable by the nip portion, the number of the recording materials each having the smaller width at a time of continuous sheet passing, in which the recording materials are passed through the nip portion continuously, with the number being stored as a history of one operation of the continuous sheet passing; and a control portion that controls a conveying speed of the recording materials when the recording materials pass through the nip portion;

wherein the control portion, in a case of the continuous sheet passing of the recording materials each having the smaller width:

executes, in a case where a representative value of the number of the recording materials having the smaller width for the one operation of the continuous sheet passing acquired from the history is smaller than a predetermined threshold, a first operating mode in which the conveying speed is controlled to a first speed; and executes, in a case where the representative value is the threshold or more, a second operating mode in which the conveying speed is controlled to a second speed lower than the first speed.

In order to achieve the object described above, an image forming system including:

an image forming apparatus including an image forming portion that forms an image on a recording material, a fixing portion including a nip portion that nips and conveys the recording material, the fixing portion heating the image the image at the nip portion to fix the image onto the recording material, and a control portion that controls a conveying speed of the recording materials when the recording materials pass through the nip portion; and a server connected to the image forming apparatus by a network that allows bidirectional access, and including a storage portion that at least stores, relative to recording materials each having a smaller width than recording materials each having a maximum width in a direction orthogonal to a conveying direction among recording materials conveyable by the nip portion, the number of the recording materials each having the smaller width at a time of continuous sheet passing, in which the recording materials are passed through the nip portion continuously, with the number being stored as a history of one operation of the continuous sheet passing, wherein the control portion, in a case of the continuous sheet passing of the recording materials each having the smaller width:

executes, in a case where a representative value of the number of the recording materials having the smaller width for the one operation of the continuous sheet passing acquired from the history is smaller than a predetermined threshold, a first operating mode in which the conveying speed is controlled to a first speed; and executes, in a case where the representative value is the threshold or more, a second operating mode in which the conveying speed is controlled to a second speed lower than the first speed.

According to the present invention, it is possible to enhance productivity irrespective of recording material size and extend the life of the apparatus. Further features of the present invention will become apparent from the following description of exemplary embodiments with reference to the attached drawings.

DESCRIPTION OF THE EMBODIMENTS

Now, modes for carrying out the present invention are exemplarily described in detail with reference to the drawings on the basis of embodiments. Note that, the dimensions, materials, and shapes of components described in the embodiments, the relative positions thereof, and the like are to be appropriately changed on the basis of the configurations of apparatus to which the present invention is applied or various conditions. That is, the scope of the present invention is not intended to be limited to the following embodiments.

Embodiment 1

Configuration of Image Forming Apparatus

Figure 1:
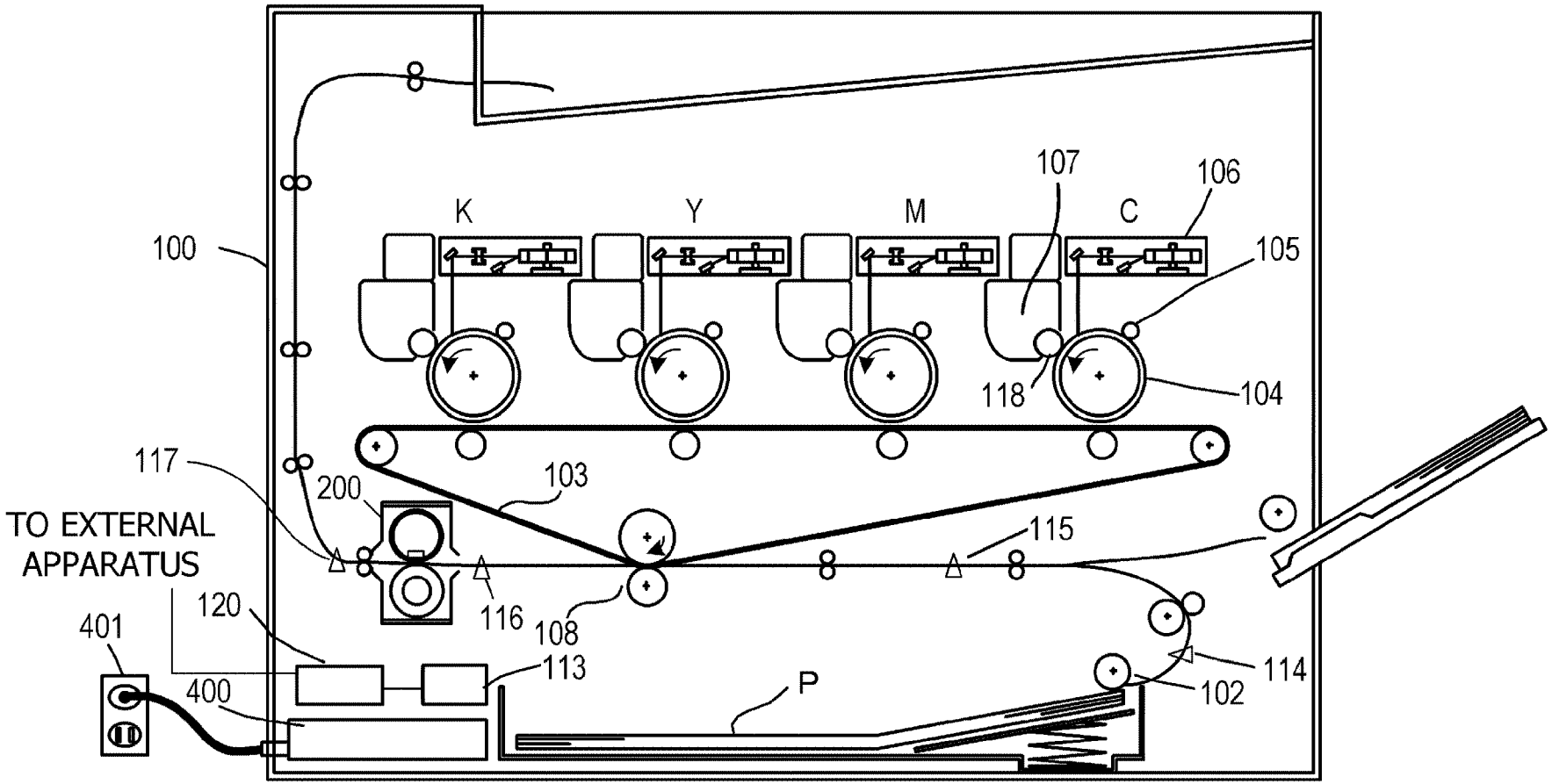
FIG. 1 is a schematic sectional view of an image forming apparatus according to Embodiments 1 and 2.

FIG. 1 is an exemplary schematic configuration view of an electrophotographic image forming apparatus according to the present embodiment. As image forming apparatus to which the present invention is applicable, electrophotographic or electrostatic recording copying machines, printers, and the like are given. Here, a case where the present invention is applied to a laser printer configured to form images on a recording material P by using an electrophotographic system is described.

A video controller 120 receives and processes image information and print instructions transmitted from an external apparatus such as a host computer. A control portion 113 is connected to the video controller 120 and controls the parts of the image forming apparatus in response to instructions from the video controller 120. When the video controller 120 receives a print instruction from the external apparatus, an image is formed through the following operation.

An image forming apparatus 100 feeds the recording material P by a feed roller 102, thereby conveying the recording material P toward an intermediate transfer member 103. A photosensitive drum 104 is driven to rotate at predetermined speed in the counterclockwise direction, and is uniformly charged by a primary charging device 105 during the rotation. A laser beam scanner 106 outputs modulated laser light based on an image signal to selectively perform scanning exposure on the photosensitive drum 104, thereby forming an electrostatic latent image. A developing device 107 drives a developing roller 118 to rotate to cause toner powder, which is a developing substance, to adhere to the electrostatic latent image to form a toner image (developing substance image) that is a visible image. The toner image formed on the photosensitive drum 104 is primarily transferred onto the intermediate transfer member 103 that rotates in contact with the photosensitive drum 104.

Here, the photosensitive drum 104, the primary charging device 105, the laser beam scanner 106, the developing device 107, and the developing roller 118 each have the four colors of cyan (C), magenta (M), yellow (Y), and black (K). Toner images of the four colors are sequentially transferred onto the intermediate transfer member 103 through the same procedure in an overlapping manner. The toner image transferred onto the intermediate transfer member 103 in an overlapping manner is, in a secondary transfer portion formed by the intermediate transfer member 103 and a transfer roller 108, secondarily transferred onto the recording material P with a transfer bias applied to the transfer roller 108. After that, a fixing apparatus (image heating apparatus) 200, which serves as a fixing portion (image heating portion), heats and pressurizes the recording material P to fix the toner image. Then, the resultant is discharged out of the apparatus as an object having the image formed thereon.

In the configuration described above, the configuration that forms the unfixed toner image on the recording material corresponds to an image forming portion of the present invention.

The control portion 113 manages the conveyance status of the recording material P with a conveyance sensor 114, a registration sensor 115, a pre-fixing sensor 116, and an image-fixed sheet discharge sensor 117 that are provided on the conveying path of the recording material P. In addition, the control portion 113 includes a storage portion configured to store a temperature control program for the fixing apparatus 200. A control circuit 400, which serves as heater driving means, is connected to a commercial alternating current power supply 401, and supplies electric power to the fixing apparatus 200. Note that, in the present embodiment, the image forming apparatus that supports the largest feedable width in a direction orthogonal to the conveying direction of the recording material P (width direction) of 216 mm is used, and hence letter size (216 mm×279 mm) recording materials can be printed.

Configuration of Fixing Apparatus (Image Heating Apparatus)

Figure 2:
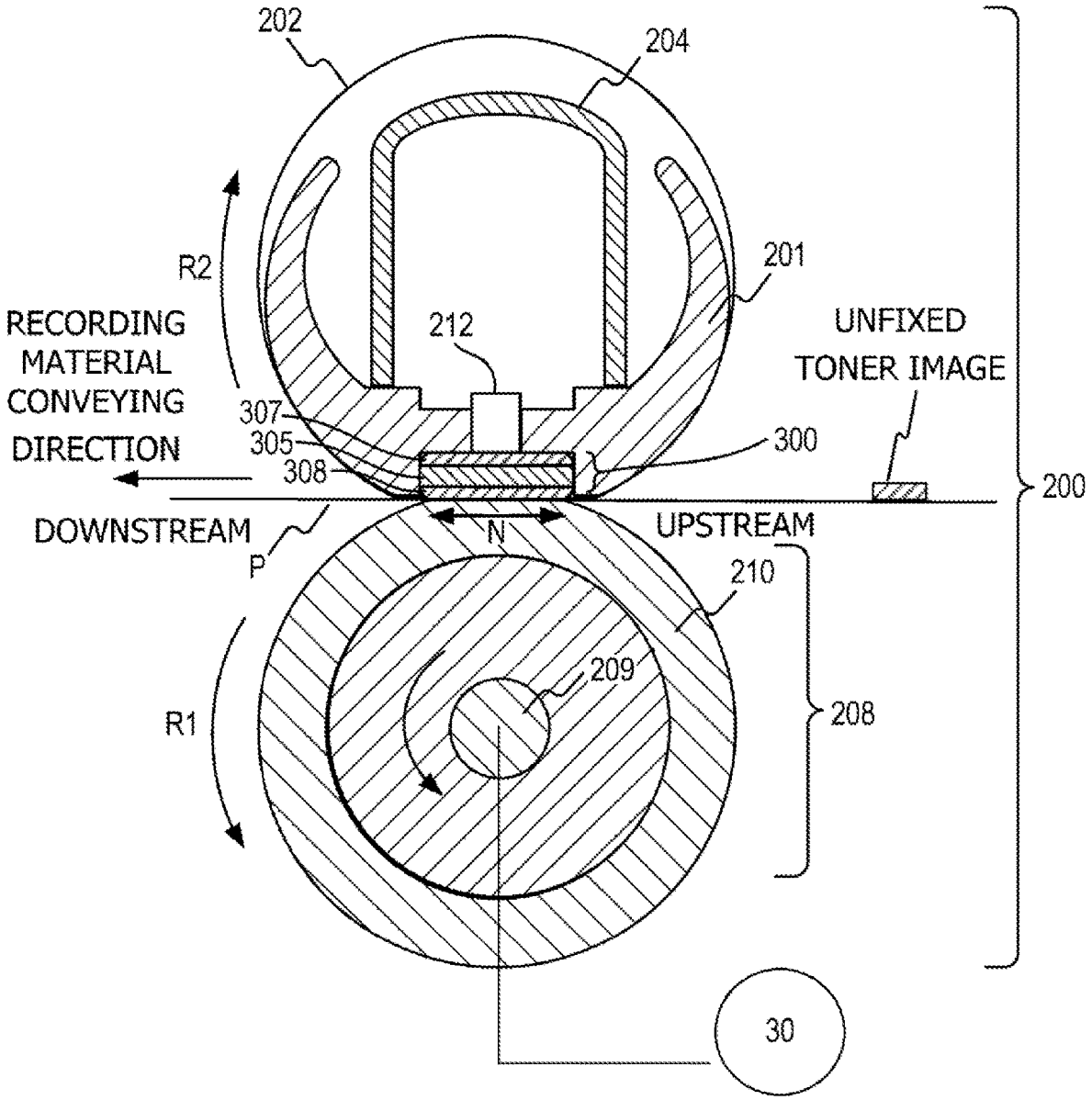
FIG. 2 is a schematic sectional view of an image heating apparatus according to Embodiments 1, 2, and 3.

FIG. 2 is a schematic sectional view of the fixing apparatus 200 according to the present embodiment. The fixing apparatus 200 includes a fixing film 202, which serves as an endless belt, a heater unit 310 in contact with the inner surface of the fixing film 202, a pressure roller 208 in contact with the outer surface of the fixing film 202, and a metal stay 204. The pressure roller 208 forms a fixing nip portion N together with a heater 300 through the fixing film 202. The heater unit 310 includes the heater 300 and a heater holding member 201 configured to hold the heater 300.

The fixing film 202 is a multilayered heat-resistant film formed into a tubular shape, and can include, as its base layer, a thin heat-resistant resin such as polyimide or a thin metal sheet such as stainless steel. Further, to ensure toner adhesion prevention and the separation from the recording material P, the surface of the fixing film 202 is covered with a heat-resistant resin having a high releasing property such as a tetrafluoroethylene perfluoro alkyl vinyl ether copolymer (PFA) so that a releasing layer is formed. In addition, in an apparatus configured to form color images in particular, to achieve image quality enhancement, heat-resistant rubber such as silicone rubber may be formed between the base layer and the releasing layer as an elastic layer.

The pressure roller 208, which serves as a pressure member, includes a core metal 209 made of, for example, iron or aluminum and an elastic layer 210 made of silicone rubber, for example.

The heater 300 is a heater that is heated by a heat generating member provided on a substrate 305 made of ceramic, and includes a surface protection layer 308 provided on the fixing nip portion N side and a surface protection layer 307 provided on the side opposite to the fixing nip portion N. Electric power is supplied from an electrode (not illustrated) provided on the side opposite to the fixing nip portion N. Further, as an element (temperature detecting portion) configured to detect the temperature of the heater 300, a thermistor 212 is in abutment against the heater 300. The heater 300 is held by the heater holding member 201 made of a heat-resistant resin, and heats the fixing film 202. The heater holding member 201 also has a guide function for guiding the rotation of the fixing film 202.

The metal stay 204 receives pressurizing force, which is not illustrated, to bias the heater holding member 201 holding the heater 300 toward the pressure roller 208, to thereby form the fixing nip portion N between the fixing film 202 and the pressure roller 208.

The pressure roller 208 receives power from a motor 30 to rotate in the direction of the arrow R1. When the pressure roller 208 rotates, the fixing film 202 follows the rotation to rotate in the direction of the arrow R2. The recording material P receives heat from the fixing film 202 while being nipped and conveyed in the fixing nip portion N so that an unfixed toner image on the recording material P is subjected to fixing treatment.

Configuration of Control Block

Figure 3:
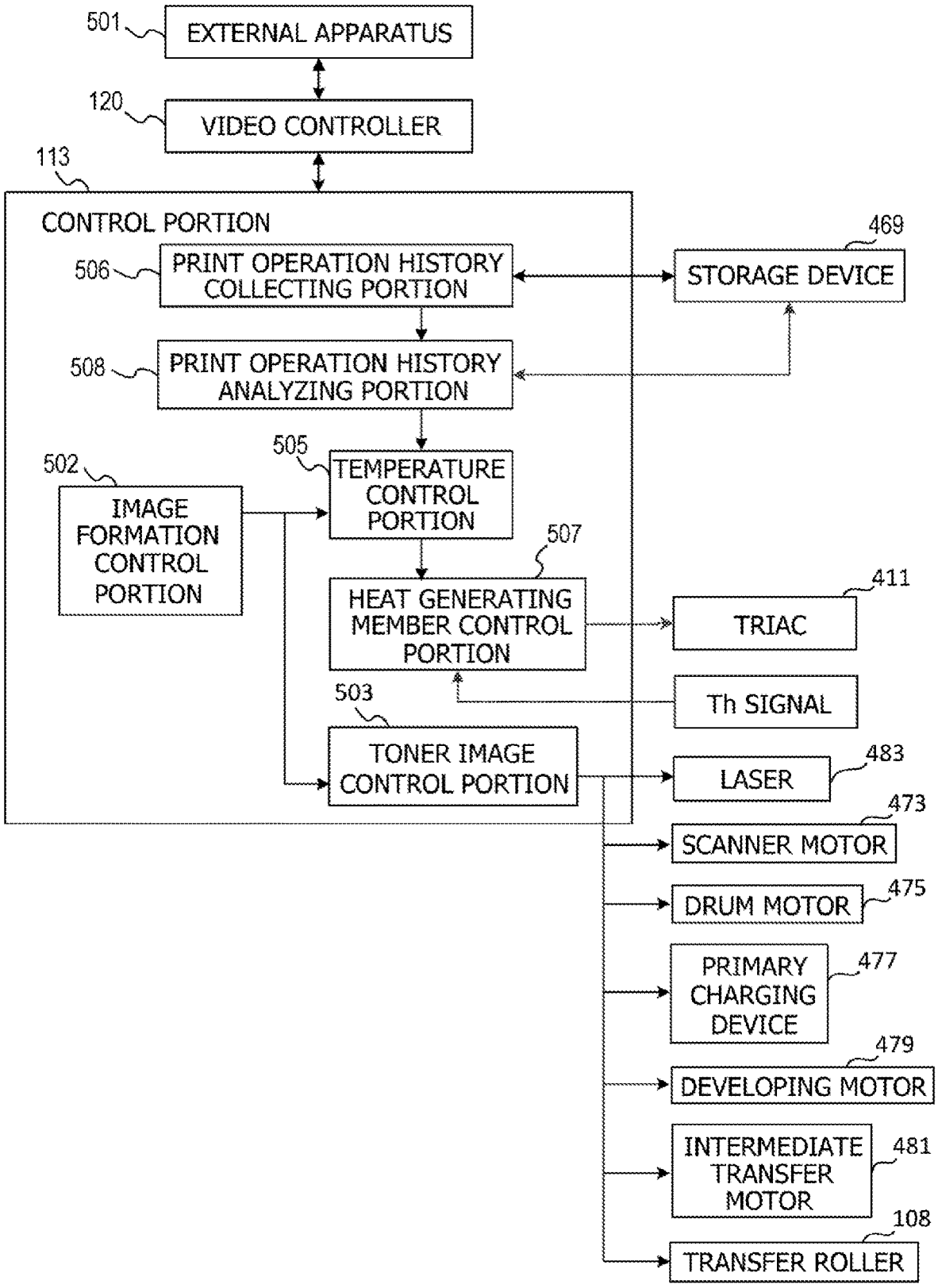
FIG. 3 is a control block diagram of Embodiment 1.

FIG. 3 is a control block diagram of the present embodiment. The video controller 120 receives and processes image information and print instructions transmitted from an external apparatus 501 such as a host computer. When receiving image information and a print instruction, the video controller 120 instructs the control portion 113 to perform preparation operation. After that, the video controller 120 converts the image information into printable information, and instructs the control portion 113 to perform image forming operation.

An image formation control portion 502 controls, in response to an instruction from the video controller 120, Preparation Operation 1 based on a preparation operation instruction before the instruction of image forming operation, Preparation Operation 2 based on a printing mode after the instruction of image forming operation, or image forming operation. In Preparation Operation 1, the fixing apparatus 200 and the laser beam scanner 106 start to be driven. In Preparation Operation 2, preparation operation that is necessary for image forming operation but has not been performed in Preparation Operation 1 is performed. Specifically, in Preparation Operation 2, the photosensitive drum 104, the primary charging device 105, the developing device 107, the intermediate transfer member 103, and the transfer roller 108 start to be driven. A printing mode corresponds to image forming conditions depending on the kinds of recording materials, and includes conveying speed, transfer conditions, target temperature for fixing, and the like.

A toner image control portion 503 controls, with an image formation instruction from the image formation control portion 502, a laser 483, a scanner motor 473, a drum motor 475, a primary charging device 477, a developing motor 479, an intermediate transfer motor 481, and the transfer bias of the transfer roller 108, to thereby form a toner image.

A temperature control portion 505 determines, with a preparation operation instruction or an image formation instruction from the image formation control portion 502, a target temperature of the heater 300 that is controlled by a heat generating member control portion 507.

A print operation history collecting portion 506 stores print operation histories in a storage device (storage portion) 469.

Next, print operation histories are described. Processing from the start of print operation with an instruction from the video controller 120 to the end of printing (image forming operation in which a plurality of recording materials having a predetermined size are fed continuously, and images are formed and fixed onto the respective plurality of recording materials continuously) is regarded as one job. Information on how many sheets have been continuously printed per job and sheet size information are stored as a print operation history. An exemplary print operation history is shown in Table 1. Information on the last 100 jobs can be stored in the history.

TABLE 1

| Print operation history | | |
|---|---|---|
| Job number | Sheet size | Number of continuously printed sheets |
| 1 | A4 | 2 |
| 2 | B5 | 10 |
| 3 | A5 | 5 |
| . . . | . . . | . . . |
| 100 | A4 | 1 |

Table 2 shows an exemplary print operation history analysis result. A print operation history analyzing portion 508 stores print operation history analysis results in the storage device 469. In print operation history analysis in the present embodiment, the average value of the number of continuously printed sheets per job is calculated in regard to each sheet size. For example, in the print operation history shown in Table 1, the last 100 jobs include three jobs using the sheet size of A5. In a case where the number of continuously printed sheets in jobs are two, four, and six, the average value of four is stored in the storage device 469 as a print operation history analysis result.

TABLE 2

| Print operation history analysis | |
|---|---|
| Sheet size | Average value of the number of continuously printed sheets |
| Letter | 0 |
| A4 | 8.2 |
| B5 | 13.8 |
| A5 | 4 |
| . . . | . . . |
| Envelope | 1.3 |

Although, in the present embodiment, the average value of the number of continuously printed sheets is used as the representative value of each analysis result, a combination of the median value, most frequent value, and standard deviation may be used instead of the average value. The representative value of the analysis result may be any one of the average value, the median value, and the most frequent value of the number of the recording materials for the one operation of the continuous sheet passing.

Control Method in Image Forming Operation

Figure 4:
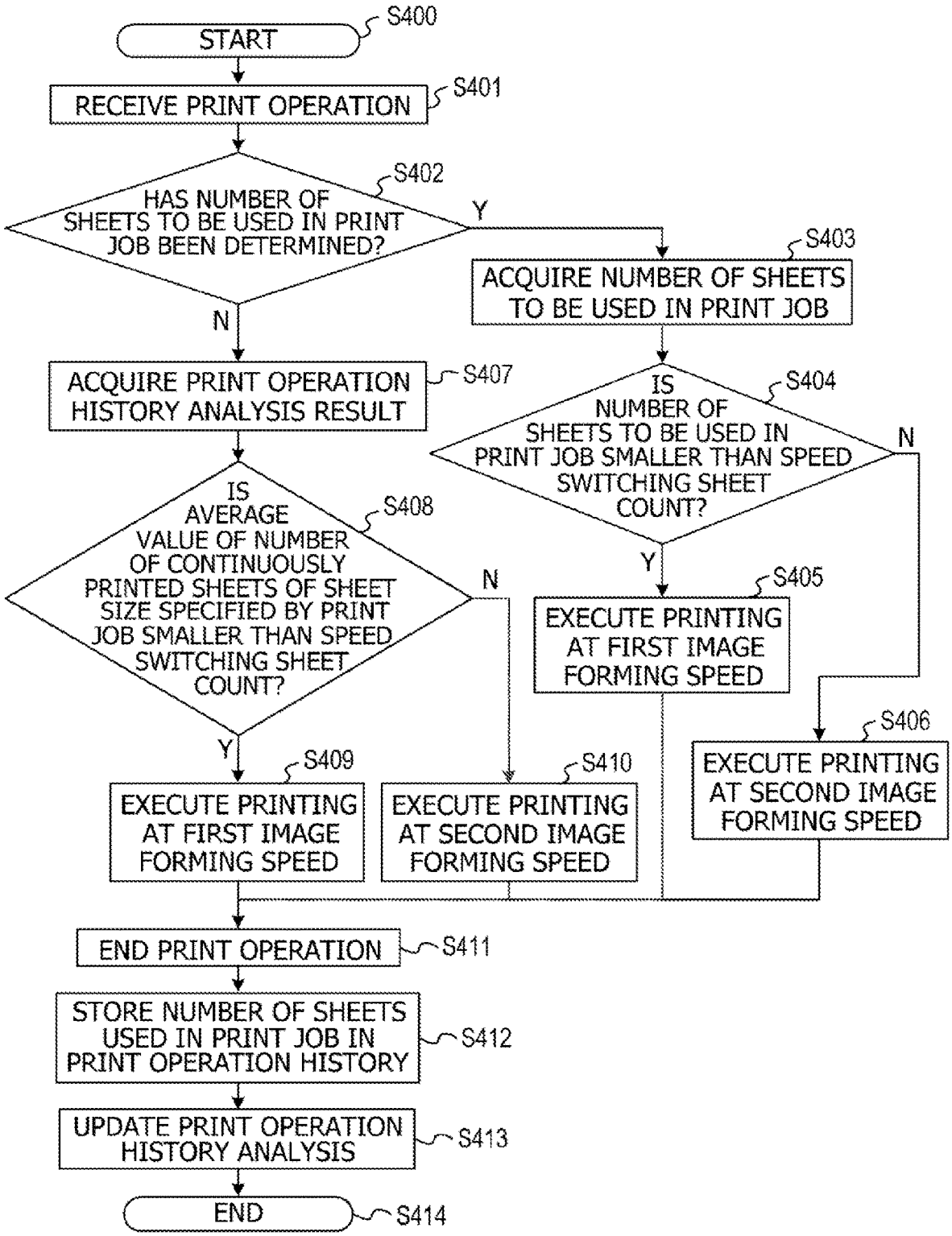
FIG. 4 is a control flowchart of Embodiment 1.

FIG. 4 is a control flowchart of the present embodiment.

In S401, when receiving image information and a print instruction transmitted from the external apparatus 501, the video controller 120 starts the processing of converting the image information into printable information. Further, the video controller 120 instructs the control portion 113 to perform preparation operation.

In S402, the image formation control portion 502 of the control portion 113 receives the preparation operation instruction, and determines whether the number of sheets to be used in the print job has been determined. For example, in a case where the number of sheets to be used in the print job is one, the number of sheets may be determined when the preparation operation instruction is received. However, in a case where a large number of sheets are to be used in the print job, the number of sheets has not been determined at this point with a high possibility.

In a case where the number of sheets to be used in the print job has been determined in S402, in S403, the image formation control portion 502 receives the number of sheets to be used in the print job from the video controller 120.

In S404, the number of sheets to be used in the print job is compared to a predetermined image forming speed switching sheet count (hereinafter referred to as "speed switching sheet count"). In a case where the number of sheets to be used in the print job is smaller, in S405, printing is executed at a first image forming speed (first operating mode). Meanwhile, in a case where the number of sheets to be used in the print job is larger than the predetermined speed switching sheet count (equal to or larger than the speed switching sheet count) in S404, in S406, printing is executed at a second image forming speed (second operating mode).

In a case where the number of sheets to be used in the print job has not been determined in S402, in S407, the print operation history analyzing portion 508 acquires a print operation history analysis result from the storage device 469.

In a case where it is determined in S408 from the print operation history analysis result that the average value of the number of continuously printed sheets of a sheet size specified by the print job is smaller than the predetermined speed switching sheet count, in S409, printing is executed at the first image forming speed. Meanwhile, in a case where it is determined in S408 that the average value of the number of continuously printed sheets is larger than the predetermined speed switching sheet count (equal to or larger than the speed switching sheet count), in S410, printing is executed at the second image forming speed. That is, in a case where the representative value of the number of sheets to be used in one continuous sheet passing is equal to or larger than a predetermined threshold, a lower recording material conveying speed is set.

When all the print jobs are finished in S411, in S412, the print operation history collecting portion 506 stores the number of sheets used in the print job in the storage device 469.

In S413, the print operation history analyzing portion 508 acquires the latest print operation history from the storage device 469, calculates the average value of the number of continuously printed sheets in regard to each sheet size, and stores the average value in the storage device 469.

Comparison of Throughput

In the image forming apparatus of the present embodiment, the first image forming speed is 200 mm/sec, while the second image forming speed is 100 mm/sec. Further, the maximum printable recording material width is the width of a letter size sheet fed by short edge feeding (216 mm). The productivity in a case where B5 size recording materials are printed as small size sheets is described with the use of the present embodiment and comparative examples.

Figure 5A:
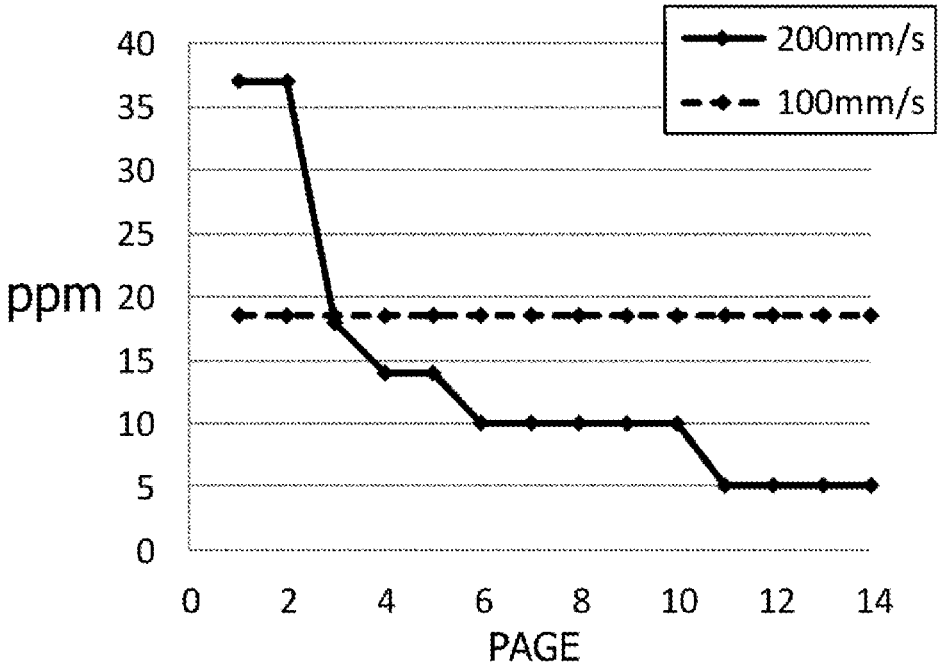
FIG. 5A and FIG. 5B are each a graph showing the throughput of Embodiment 1.

FIG. 5A is a graph showing a relationship between the number of sheets of continuous printing [pages] and the throughput (ppm: pages per minute) in a case where B5 size sheets are fed at the first image forming speed (200 mm/sec) and the second image forming speed (100 mm/sec).

A fixation temperature when the first image forming speed is used (a control target temperature that a temperature detected by the thermistor 212 is to take) is approximately 200° C. in the present embodiment in terms of fixing performance. In the case where the sheets are fed at the first image forming speed, the feeding first starts at 37 ppm, and the temperature of a non-sheet-passage part rises to approach the heat-resistant temperature of the fixing unit due to a non-sheet-passage-part temperature rise around the third sheet. Thus, the throughput, which represents the number of recording materials that are passed through the fixing nip portion per unit time, is gradually reduced from 18 ppm to 5 ppm (the sheet interval (the conveying interval between the recording materials) is increased).

Meanwhile, a fixation temperature when the second image forming speed is used is a temperature of approximately 150° C., which is lower than the fixation temperature that is set when the first image forming speed is used, since the second image forming speed is lower than the first image forming speed. Thus, the fixation temperature itself is low and a non-sheet-passage-part temperature rise is thus small. In the case where the sheets are fed at the second image forming speed, the feeding first starts at approximately 18.5 ppm, and after that, the temperature of the non-sheet-passage part does not approach the heat-resistant temperature of the fixing unit. Thus, the throughput can be kept at 18.5 ppm.

Figure 6A:
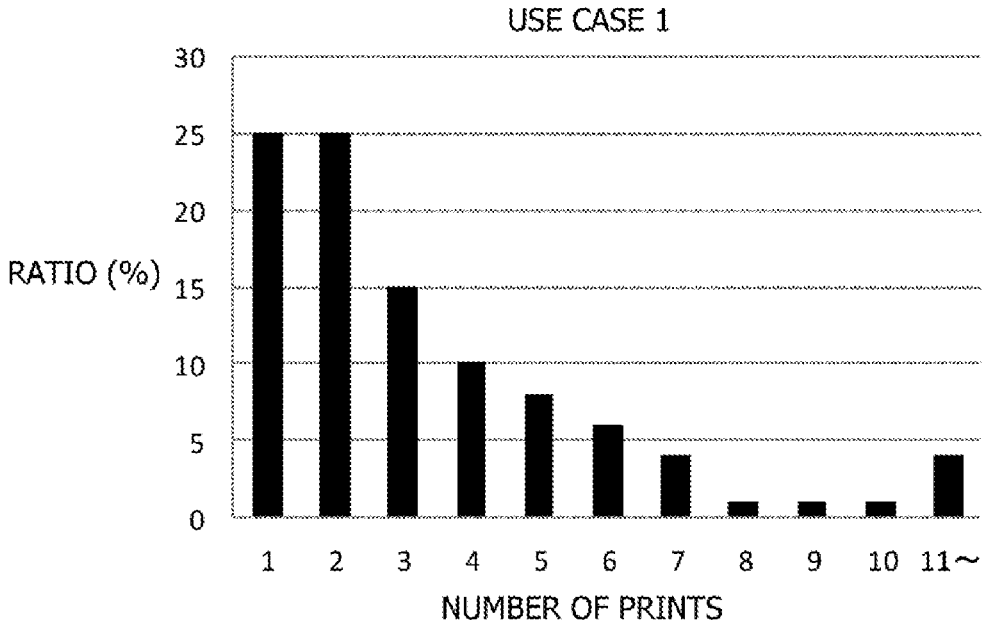
FIG. 6A and FIG. 6B are each a graph showing use cases of Embodiment 1.
Figure 6B:
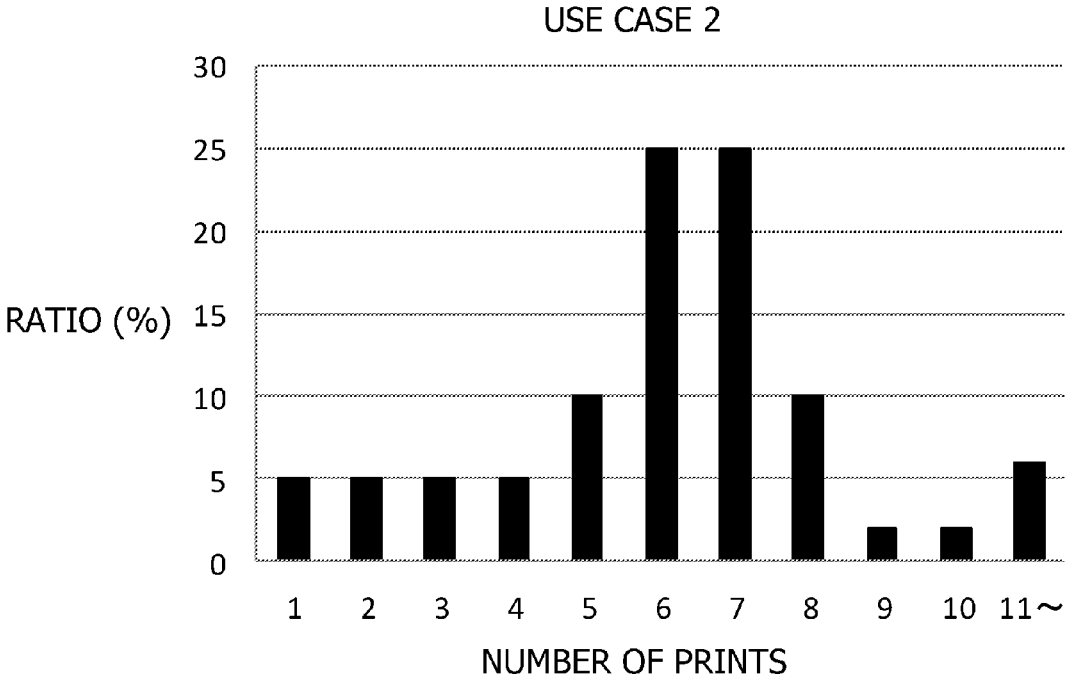

Next, in a case where B5 size sheets are printed by an image forming apparatus on the market, the number of sheets to be continuously printed depends on users. In the present embodiment, two types of cases are assumed as use cases. FIG. 6A shows, as Use Case 1, the ratio of the number of prints to all jobs. For example, the ratio of the case where one sheet is printed is 25% of all the jobs. Further, the ratio of the case where 11 or more sheets are printed, which is defined as one section, is 4%. Next, as the second use case, FIG. 6B shows Use Case 2. In Use Case 2, it is assumed that the tendency of the number of prints is different from the one in Use Case 1, and the ratios of six and seven print sheets are the largest. Further, the ratio of 11 or more print sheets, which is defined as one section, is 6%. That is, in the present embodiment, it is assumed that when printing B5 size sheets, a certain user uses the image forming apparatus as in Use Case 1, and another user uses the image forming apparatus as in Use Case 2.

Figure 5B:
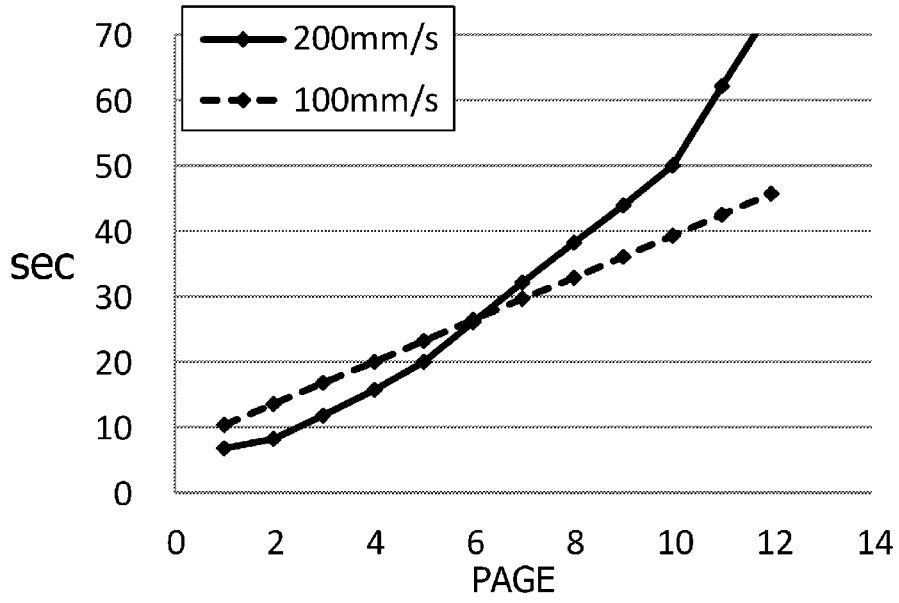

Next, to make a B5 size sheet throughput comparison, Comparative Example 1 is described. In Comparative Example 1, the image forming speed is fixed to the first image forming speed (200 mm/sec), and a large sheet interval is set to prevent a non-sheet-passage-part temperature rise. The throughput of each number of prints in this case is indicated by the graph of the solid line (200 mm/sec) of FIG. 5A. Further, the start to end time of the printing of each number of prints (print time) is as shown in Table 3, and is indicated by the graph of the solid line of FIG. 5B.

TABLE 3

| Print time at 200 mm/sec | |
|---|---|
| Number of prints | Print time (sec) |
| 1 | 6.6 |
| 2 | 8.2 |
| 3 | 11.6 |
| 4 | 15.9 |
| 5 | 21.1 |
| 6 | 26.1 |
| 7 | 32.1 |
| 8 | 38.1 |
| 9 | 44.1 |
| 10 | 50.1 |
| 11 | 62.1 |
| 12 | 74.1 |
| 13 | 86.1 |
| 14 | 98.1 |
| 15 | 110.1 |

Here, assuming that a user performs printing with the ratio in Use Case 1, for example, in a case where the total number of jobs is 100, one-sheet printing is performed in 25 jobs, two-sheet printing is performed in 25 jobs, and three-sheet printing is performed in 15 jobs. In Use Case 1, print time required for performing the printing of the 100 jobs is 1,729 seconds from Table 4.

TABLE 4

| Use Case 1: time required for 100 jobs (Comparative Example 1) | | |
|---|---|---|
| Number of prints | Number of jobs | Print time (sec) |
| 1 | 25 | (6.6 × 25–) 165 |
| 2 | 25 | (8.2 × 25=) 205 |
| 3 | 15 | (11.6 × 15–) 174 |
| 4 | 10 | (15.9 × 10=) 159 |
| 5 | 8 | (21.1 × 8=) 169 |
| 6 | 6 | (26.1 × 6=) 157 |
| 7 | 4 | (32.1 × 4=) 128 |
| 8 | 1 | (38.1 × 1=) 38 |
| 9 | 1 | (44.1 × 1=) 44.1 |
| 10 | 1 | (50.1 × 1=) 50 |
| 11 or more | 4 | (110.1 × 4–) 440 |
| Total | 100 | 1729 |

That is, in Use Case 1, since the ratio of the jobs in which the number of prints is one is 25%, it can be assumed that the 25 jobs of the 100 jobs are such jobs. Further, since the time required for printing one sheet is 6.6 seconds, the total required time is 165 seconds. Further, also in the case where the number of prints is two or more, similar calculation can be applied. The ratio of the jobs in which the number of prints is 11 or more is 4%, and a value corresponding to 15 sheets is used as a representative value in print time calculation. This is because, it is assumed that the median frequency value of the jobs using 11 or more sheets is 15. Thus, assuming Use Case 1 in Comparative Example 1, time required for processing the 100 print jobs is 1,729 seconds.

Next, assuming that the user performs printing with the ratio in Use Case 2, in a case where the total number of jobs is 100, a total required print time is 3,109 seconds from Table 5.

TABLE 5

| Use Case 2: time required for 100 jobs (Comparative Example 1) | | |
|---|---|---|
| Number of prints | Number of jobs | Print time (sec) |
| 1 | 5 | (6.6 × 5−) 33 |
| 2 | 5 | (8.2 × 5=) 41 |
| 3 | 5 | (11.6 × 5=) 58 |
| 4 | 5 | (15.9 × 5=) 80 |
| 5 | 10 | (21.1 × 10=) 211 |
| 6 | 25 | (26.1 × 25=) 653 |
| 7 | 25 | (32.1 × 25=) 803 |
| 8 | 10 | (38.1 × 10=) 381 |
| 9 | 2 | (44.1 × 2=) 88 |
| 10 | 2 | (50.1 × 2=) 100 |
| 11 or more | 6 | (110.1 × 6=) 661 |
| Total | 100 | 3109 |

Next, Comparative Example 2 is described. In Comparative Example 2, the image forming speed is switched between sheet sizes. In a case where B5 size sheets are printed, the second image forming speed (100 mm/sec) is used. The throughput of each number of prints in this case is indicated by the graph of the broken line of FIG. 5A (100 mm/sec), and takes a constant value of 18.5 ppm. Further, the start to end time of the printing of each number of prints is shown in Table 6, and is indicated by the graph of the broken line of FIG. 5B.

TABLE 6

| Print time at 100 mm/sec | |
|---|---|
| Number of prints | Print time (sec) |
| 1 | 10.2 |
| 2 | 13.5 |
| 3 | 16.7 |
| 4 | 20.0 |
| 5 | 23.2 |
| 6 | 26.5 |
| 7 | 29.7 |
| 8 | 32.9 |
| 9 | 36.2 |
| 10 | 39.4 |
| 11 | 42.7 |
| 12 | 45.9 |
| 13 | 49.2 |
| 14 | 52.4 |
| 15 | 55.6 |

Here, assuming that the user performs printing with the ratio in Use Case 1, in a case where the total number of jobs is 100, a total required print time is 1,838 seconds from Table 7.

TABLE 7

| Use Case 1: time required for 100 jobs (Comparative Example 2) | | |
|---|---|---|
| Number of prints | Number of jobs | Print time (sec) |
| 1 | 25 | (10.2 × 25−) 256 |
| 2 | 25 | (13.5 × 25=) 337 |
| 3 | 15 | (16.7 × 15=) 251 |
| 4 | 10 | (20.0 × 10=) 200 |
| 5 | 8 | (23.2 × 8=) 186 |
| 6 | 6 | (26.5 × 6=) 159 |
| 7 | 4 | (29.7 × 4=) 119 |
| 8 | 1 | (32.9 × 1−) 33 |
| 9 | 1 | (36.2 × 1−) 36 |
| 10 | 1 | (39.4 × 1=) 39 |
| 11 or more | 4 | (55.6 × 4=) 223 |
| Total | 100 | 1838 |

Next, assuming that the user performs printing with the ratio in Use Case 2, in a case where the total number of jobs is 100, a total required print time is 2,755 seconds from Table 8.

TABLE 8

| Use Case 2: time required for 100 jobs (Comparative Example 1) | | |
|---|---|---|
| Number of prints | Number of jobs | Print time (sec) |
| 1 | 5 | (10.2 × 5=) 51 |
| 2 | 5 | (13.5 × 5=) 68 |
| 3 | 5 | (16.7 × 5−) 84 |
| 4 | 5 | (20.0 × 5=) 100 |
| 5 | 10 | (23.2 × 10=) 232 |
| 6 | 25 | (26.5 × 25=) 663 |
| 7 | 25 | (29.7 × 25=) 743 |
| 8 | 10 | (32.9 × 10=) 329 |
| 9 | 2 | (36.2 × 2−) 72 |
| 10 | 2 | (39.4 × 2=) 79 |
| 11 or more | 6 | (55.6 × 6−) 334 |
| Total | 100 | 1838 |

Next, control of the present embodiment is described. In the present embodiment, the image forming speed is switched depending on the operation history of the image forming apparatus. That is, print operation is executed with the use of different image forming speeds depending on use cases. A predetermined image forming speed switching sheet count in the present embodiment is set to six. That is, in a case where the average value of the number of sheets of continuous printing in regard to each sheet size, which has been calculated by the print operation history analyzing portion 508, is less than six, printing is performed at the first image forming speed. In a case where the average value is six or more, printing is performed at the second image forming speed. Here, in the case where the jobs are executed with the ratio in Use Case 1, the average value of the number of sheets of continuous printing, which serves as an operation history, is 3.5. Meanwhile, in the case where the jobs are executed with the ratio in Use Case 2, the average value of the number of sheets of continuous printing, which serves as an operation history, is 6.3.

Thus, with the control of Embodiment 1, in the case of Use Case 1, since B5 size sheets are printed at 200 mm/sec, 100 print jobs are performed in the total print time of 1,729 seconds. Further, in the case of Use Case 2, since printing is performed at 100 mm/sec, 100 print jobs are performed in the total print time of 2,755 seconds.

A comparison of total print time in the case where 100 jobs are printed as described above is shown in Table 9.

TABLE 9

| Comparison of total print time of 100 jobs | | |
|---|---|---|
| | Use Case 1 | Use Case 2 |
| Comparative Example 1 | 1729 seconds | 3109 seconds |
| Comparative Example 2 | 1838 seconds | 2755 seconds |
| Embodiment 1 | 1729 seconds | 2755 seconds |

In the case of Comparative Example 1, since the image forming speed is 200 mm/sec, when the ratio of jobs using a small number of sheets is high as in Use Case 1, printing can be finished in the time shorter than that in Comparative Example 2. However, when the ratio of jobs using a large number of sheets is high as in Use Case 2, the print time is longer than that in Comparative Example 2. Further, in contrast, in Comparative Example 2, the print time is long in Use Case 1, but printing is finished in the short time in Use Case 2.

Meanwhile, in Embodiment 1, since the image forming speed is switched depending on the operation history, printing can be finished in the shortest time in both Use Case 1 and Use Case 2.

As described above, in the present embodiment, the operation history of the image forming apparatus is stored. The average value of the number of sheets of continuous printing is calculated in regard to each sheet size, and this average value is compared to the predetermined speed switching sheet count so that the image forming speed is determined. Thus, an optimal image forming speed can be selected for each use case, with the result that the print productivity can be maximized. Further, in the present embodiment, the predetermined image speed switching sheet count is set to six for B5 size sheets, but the switching sheet count may be changed between sheet sizes.

That is, in the present embodiment, the operation history, which is updated every time the apparatus is used, is reflected in control selection criteria. More optimal fixing operation control suitable for the users' tendency of the number of prints can be made, with the result that the productivity can be enhanced and the life of the apparatus can be extended due to a reduction in load on the components of the apparatus. Note that, it is sufficient that history information that the storage portion stores at least includes the number of continuously fed sheets of recording materials in sizes having the problem of a non-sheet-passage-part temperature rise. The storage portion may not store all recording materials in conveyable sizes.

Embodiment 2

In the present embodiment, as the operation history of the image forming apparatus, operation histories for respective user IDs are analyzed. The configurations of image forming apparatus, image heating apparatus, and control blocks of Embodiment 2 are similar to those of Embodiment 1. Matters not specifically described in Embodiment 2 are similar to those of Embodiment 1.

The print operation history collecting portion 506 of the present embodiment collects, for each print job, sheet size information, information on the number of continuously printed sheets, and user ID information, and stores the information in the storage device 469. Here, user ID information includes user IDs uniquely set to distinguish, in a case where the image forming apparatus is connected to a plurality of external apparatus 501 (host computers) via a network, the host computers. An exemplary operation history stored in the storage device 469 is shown in Table 10. Information on the last 500 jobs can be stored in the history. User IDs of from "001" are assigned to respective host computers connected to the apparatus via a network.

TABLE 10

Print operation history

| Job number | User ID | Sheet size | Number of continuously printed sheets |
|---|---|---|---|
| 1 | 001 | A4 | 2 |
| 2 | 002 | B5 | 10 |
| 3 | 001 | A5 | 5 |
| . . . | . . . | . . . | . . . |
| 500 | 005 | A4 | 1 |

Next, an exemplary print operation history analysis result in the present embodiment is shown in Table 11. The average value of the number of continuously printed sheets is calculated in regard to each user ID and sheet size, and the results are stored in the storage device 469.

TABLE 11

Print operation history analysis

| User ID | Sheet size | Average value of the number of continuously printed sheets |
|---|---|---|
| 001 | Letter | 0 |
| 001 | A4 | 8.2 |
| . . . | . . . | . . . |
| 001 | Envelope | 1.3 |
| 002 | Letter | 4.3 |
| 002 | A4 | 0 |
| . . . | . . . | . . . |

Although, in the present embodiment, the average value of the number of continuously printed sheets is used as the representative value of each analysis result, a combination of the median value, most frequent value, and standard deviation may be used instead of the average value. The representative value of the analysis result may be any one of the average value, the median value, and the most frequent value of the number of the recording materials for the one operation of the continuous sheet passing.

Control Method for Image Forming Operation

Figure 7:
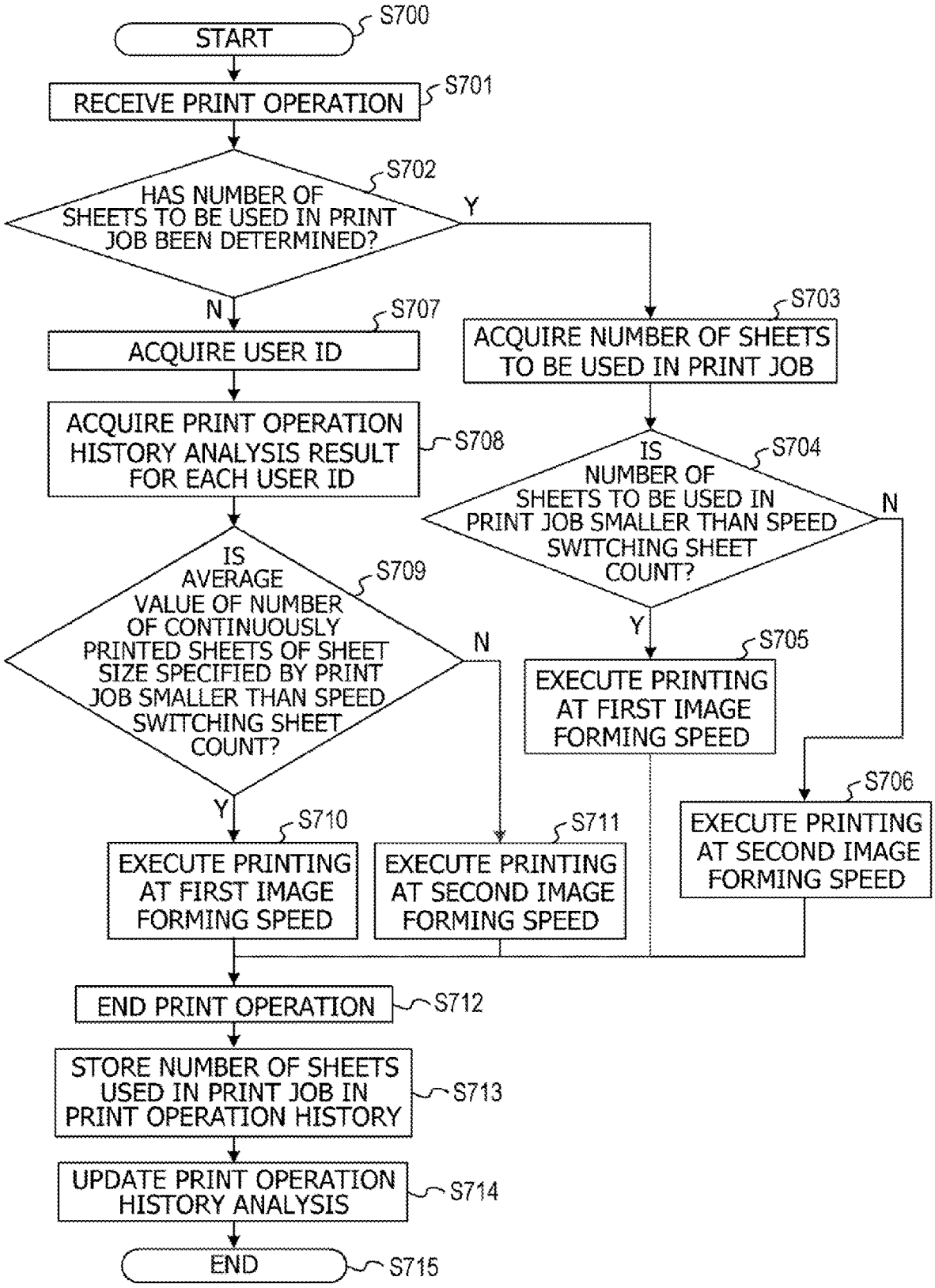
FIG. 7 is a control flowchart of Embodiment 2.

FIG. 7 is a control flowchart of the present embodiment.

In S701, when receiving image information and a print instruction transmitted from the external apparatus 501, the video controller 120 starts the processing of converting the image information into printable information. Further, the video controller 120 instructs the control portion 113 to perform preparation operation.

In S702, the image formation control portion 502 of the control portion 113 receives the preparation operation instruction, and determines whether the number of sheets to be used in the print job has been determined.

In a case where the number of sheets to be used in the print job has been determined in S702, in S703, the image formation control portion 502 receives the number of sheets to be used in the print job from the video controller 120.

In S704, the number of sheets to be used in the print job is compared to a predetermined speed switching sheet count. In a case where the number of sheets to be used in the print job is smaller, in S705, printing is executed at the first image forming speed. Meanwhile, in a case where the number of sheets to be used in the print job is larger than the predetermined speed switching sheet count in S704, in S706, printing is executed at the second image forming speed.

In a case where the number of sheets to be used in the print job has not been determined in S702, in S707, user ID information is acquired from the external apparatus 501.

In S708, the print operation history analyzing portion 508 acquires a print operation history analysis result based on a user ID and sheet size information specified by the storage device 469.

In a case where it is determined in S709 from the print operation history analysis result that the average value of the number of continuously printed sheets of the sheet size specified by the print job is smaller than the predetermined speed switching sheet count, in S710, printing is executed at the first image forming speed. Meanwhile, in a case where it is determined in S709 that the average value of the number of continuously printed sheets is larger than the predetermined speed switching sheet count (equal to or larger than the speed switching sheet count), in S711, printing is executed at the second image forming speed.

When all the print jobs are finished in S712, in S713, the print operation history collecting portion 506 stores the number of sheets used in the print job in the storage device 469.

In S714, the print operation history analyzing portion 508 acquires the latest print operation history from the storage device 469, calculates the average value of the number of continuously printed sheets in regard to each user ID and sheet size, and stores the average value in the storage device 469.

As described above, in the present embodiment, the user IDs are assigned to the respective host computers connected to the apparatus via the network, and the operation histories for the respective users are analyzed. Thus, since use cases can be predicted depending on the user IDs, an optimal image forming speed can be selected for each user ID, with the result that the print productivity can be maximized.

Embodiment 3

Figure 11:
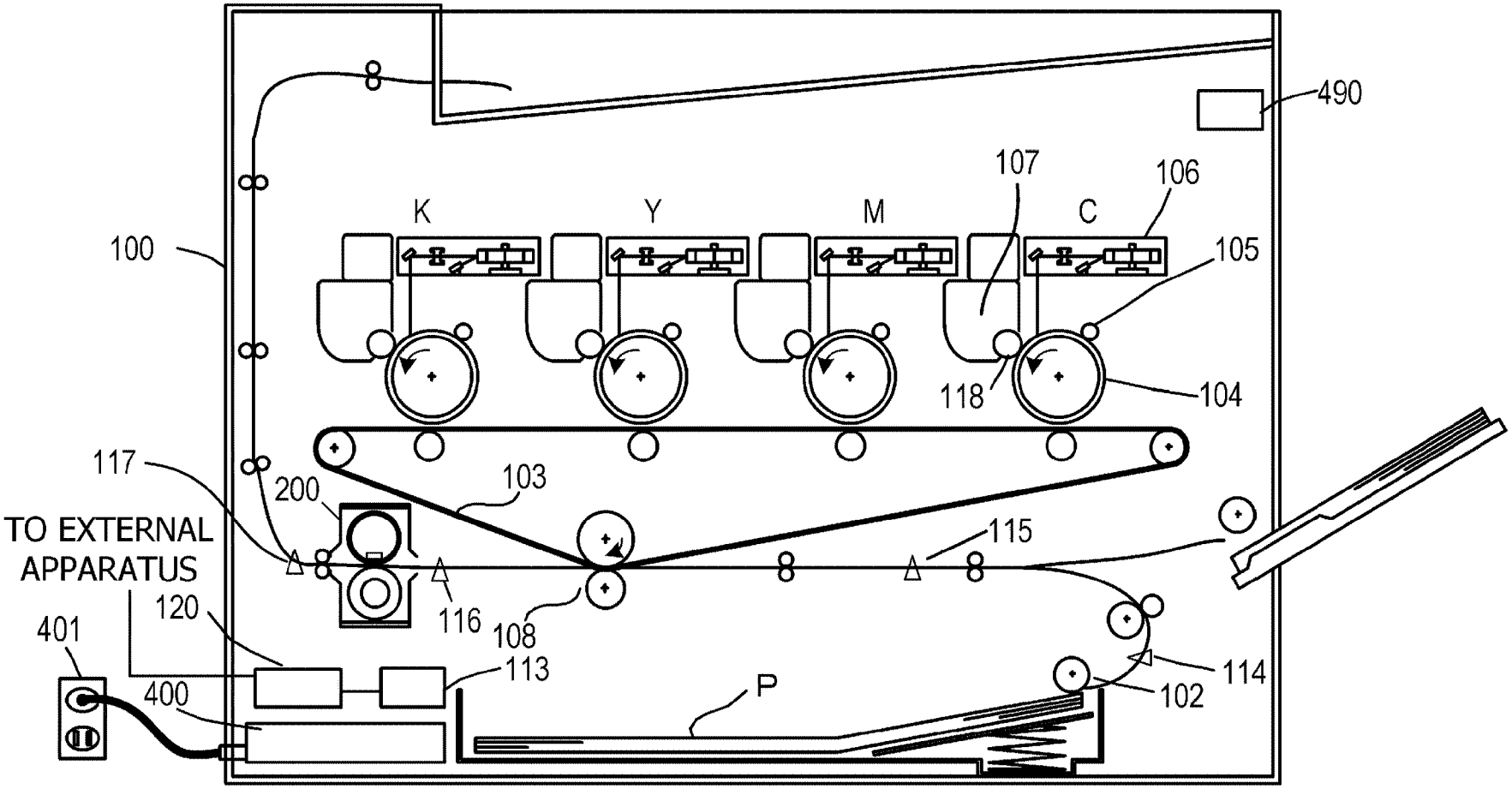
FIG. 11 is a schematic sectional view of an image forming apparatus according to Embodiment 3.

In the present embodiment, a predetermined sheet count for determining whether to switch the image forming speed is changeable depending on a temperature in an environment in which the image forming apparatus is arranged. The configurations of the image forming apparatus, image heating apparatus, and control blocks of Embodiment 3 are similar to those of Embodiment 1 except for that Embodiment 3 includes an environmental temperature detecting sensor 490 as an environmental information acquiring portion as illustrated in FIG. 11. Matters not specifically described in Embodiment 3 are similar to those of Embodiments 1 and 2.

Note that, information acquired as environmental information may be humidity, absolute humidity, or the like instead of temperature.

Figure 8A:
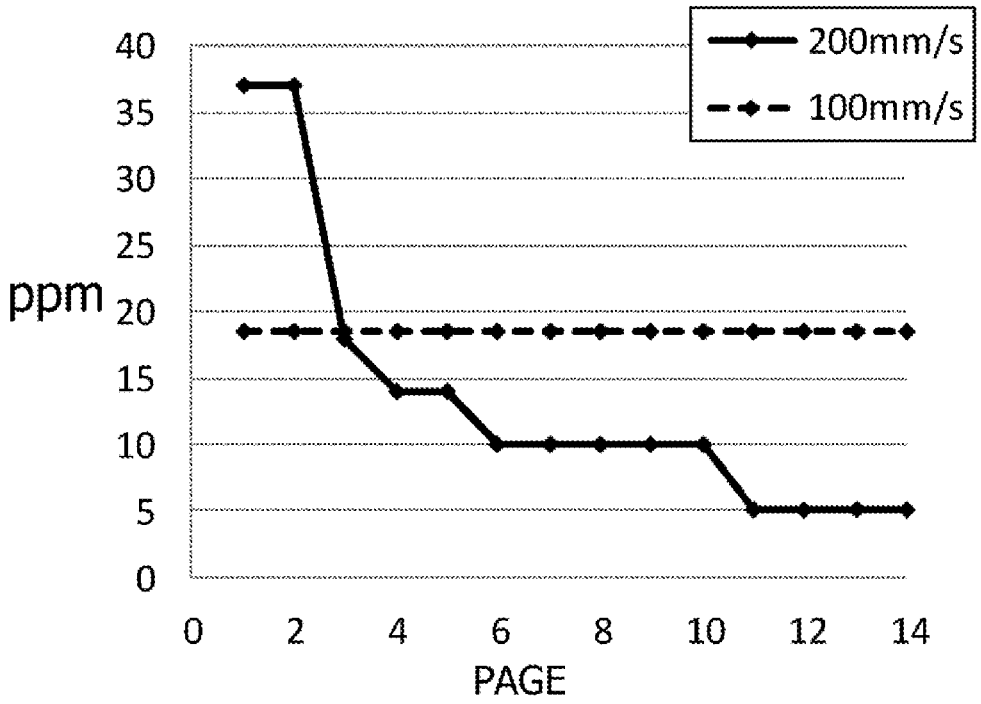
FIG. 8A and FIG. 8B are each a graph showing the throughput of Embodiment 3.

FIG. 8A is a graph showing a relationship between the number of continuously printed sheets [pages] and the throughput in a case where B5 size sheets are fed at the first image forming speed (200 mm/sec) and the second image forming speed (100 mm/sec) at an environmental temperature of 20° C. Further, FIG. 8B is a similar graph showing a case at an environmental temperature of 30° C.

Figure 8B:
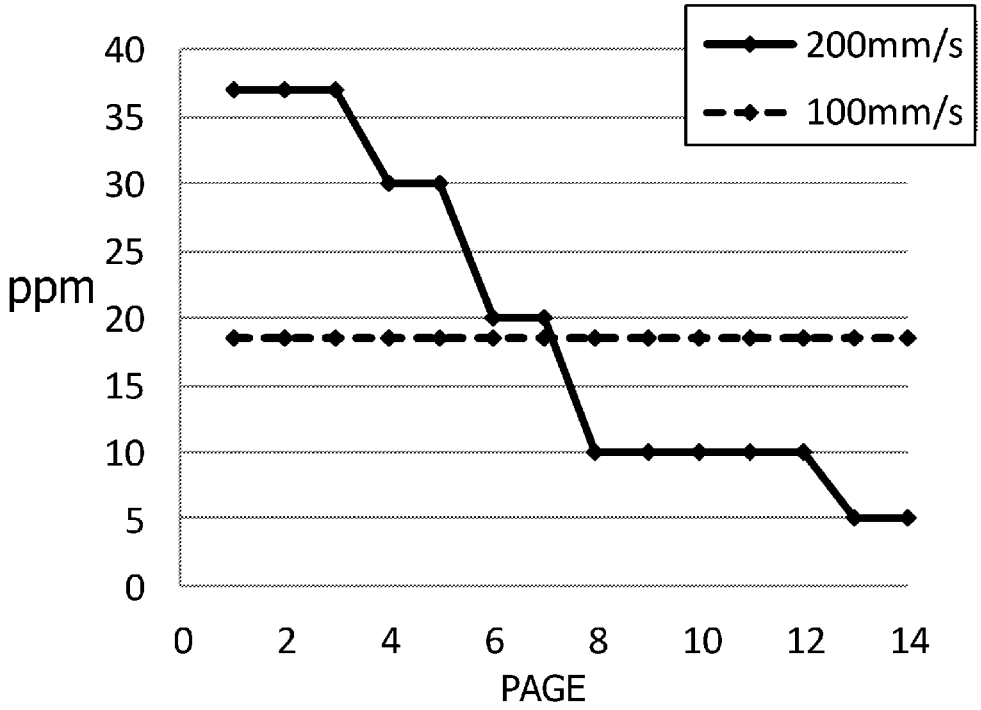

As compared to FIG. 8A in which the environmental temperature is 20° C., in the case of FIG. 8B in which the environmental temperature is 30° C., the amount of heat necessary for fixing is small, and hence the fixing film can be set to a low setting temperature. Thus, a non-sheet-passage-part temperature rise is prevented, and hence when the throughput is gradually reduced at the image forming speed of 200 mm/sec, the range of reduction is gentle. Meanwhile, in the case where the image forming speed is 100 mm/sec, a reduction in throughput due to a non-sheet-passage-part temperature rise does not occur irrespective of environmental temperature.

Figure 9A:
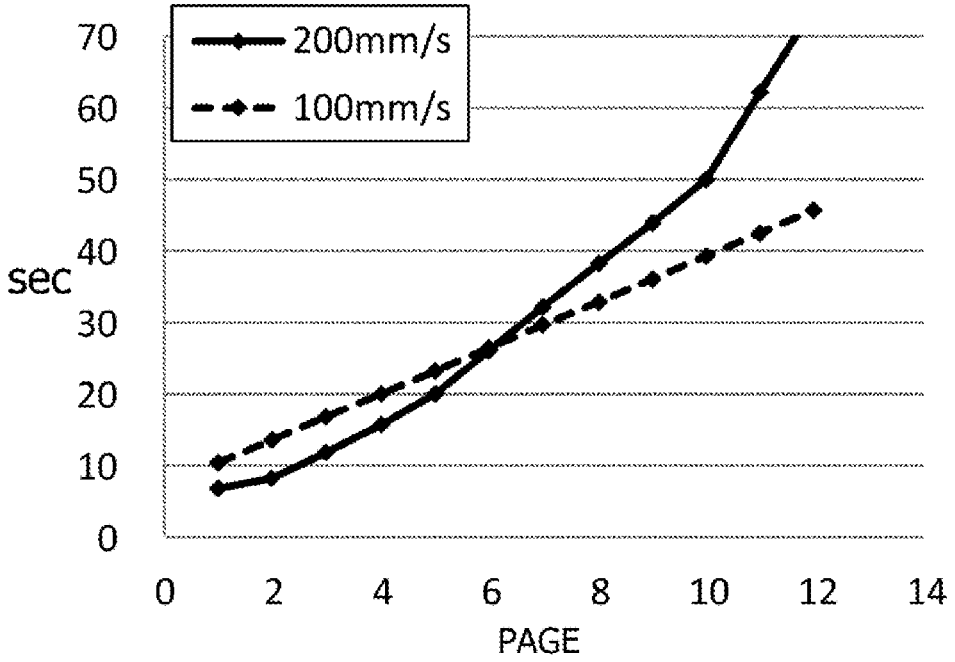
FIG. 9A and FIG. 9B are each a graph showing the throughput of Embodiment 3.
Figure 9B:
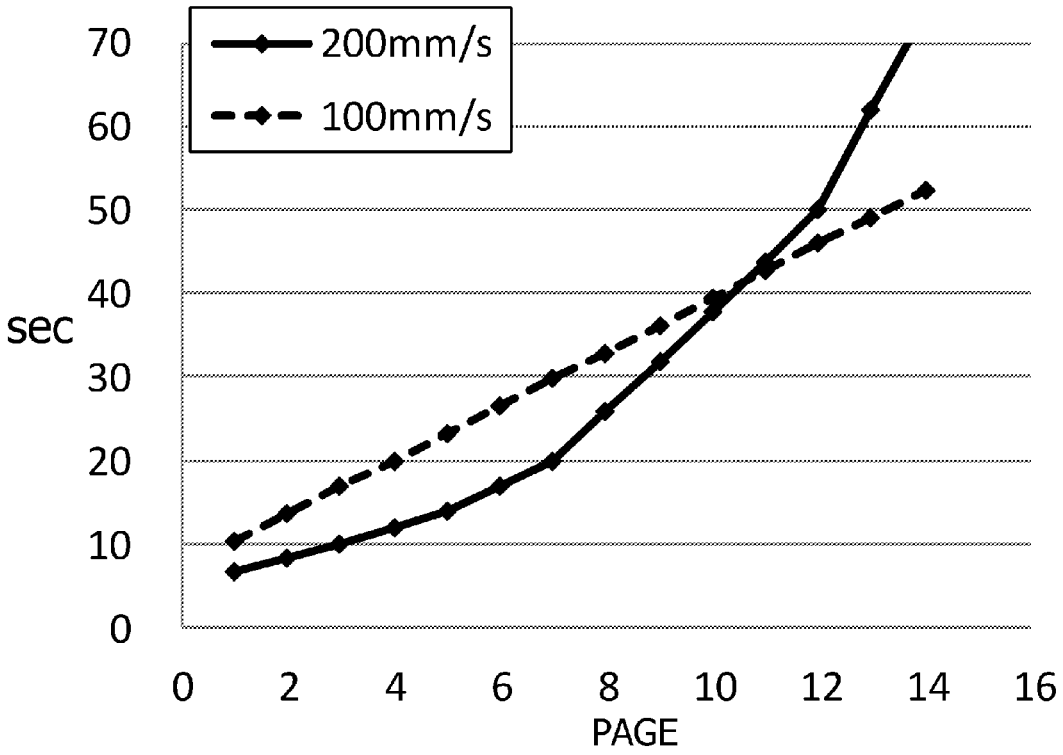

Next, the start to end time of the printing of each number of prints is shown in FIG. 9. FIG. 9A is a time when printing is performed with throughput control for the environmental temperature of 20° C., and FIG. 9B is a time when printing is performed with throughput control for the environmental temperature of 30° C. In FIG. 9A, it is found that in a case where the number of prints is six or less, printing at 200 mm/sec achieves a higher productivity, but printing at 100 mm/sec achieves a higher productivity when the number of prints is seven or more. Meanwhile, in FIG. 9B, it is found that the productivity at the image forming speed of 200 mm/sec and the productivity at the image forming speed of the 100 mm/sec are reversed with a boundary being 10 print sheets. That is, in a case where an environmental temperature is high, a large value is set as a predetermined print sheet count for determining whether to switch the image forming speed so that the print productivity is maximized.

Control Method for Image Forming Operation

Figure 10:
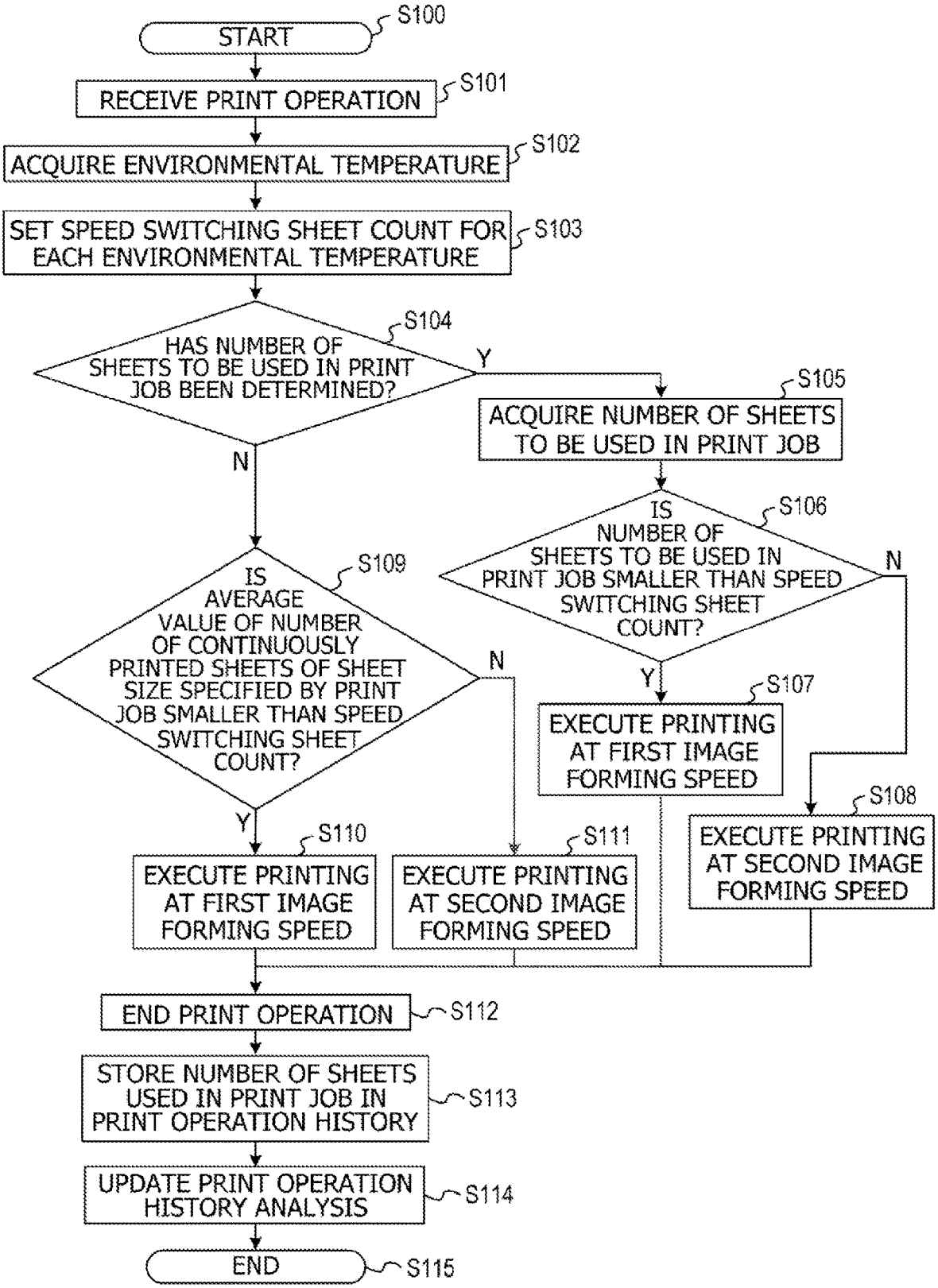
FIG. 10 is a control flowchart of Embodiment 3.

FIG. 10 is a control flowchart of the present embodiment.

In S101, when receiving image information and a print instruction transmitted from the external apparatus 501, the video controller 120 starts the processing of converting the image information into printable information. Further, the video controller 120 instructs the control portion 113 to perform preparation operation.

In S102, the control portion 113 acquires environmental temperature from the environmental temperature detecting sensor 490 installed in the image forming apparatus.

In S103, a speed switching sheet count for each environmental temperature is set. Image forming speed switching sheet counts for each environmental temperature in a case where B5 size sheets are continuously printed in the present embodiment are shown in Table 12.

TABLE 12

| Environmental temperature | Speed switching sheet count |
|---|---|
| 15° C. or less | 5 |
| 15° C. to 20° C. | 6 |
| 20° C. to 22° C. | 7 |
| 22° C. to 24° C. | 8 |
| 24° C. to 26° C. | 9 |
| 26° C. to 28° C. | 10 |
| 30° C. or more | 11 |

In S104, the control portion 113 determines whether the number of sheets to be used in the print job has been determined.

In a case where the number of sheets to be used in the print job has been determined in S104, in S105, the image formation control portion 502 receives the number of sheets to be used in the print job from the video controller 120.

In S106, the number of sheets to be used in the print job is compared to the speed switching sheet count set in S103. In a case where the number of sheets to be used in the print job is smaller, in S107, printing is executed at the first image forming speed. Meanwhile, in a case where the number of sheets to be used in the print job is larger than the speed switching sheet count in S106, in S108, printing is executed at the second image forming speed.

In a case where the number of sheets to be used in the print job has not been determined in S104, when it is determined in S109 from a print operation history analysis result that the average value of the number of continuously printed sheets of the sheet size specified by the print job is smaller than the speed switching sheet count, in S110, printing is executed at the first image forming speed. Meanwhile, in a case where it is determined in S109 that the average value of the number of continuously printed sheets is larger than the speed switching sheet count (equal to or larger than the speed switching sheet count), in S111, printing is executed at the second image forming speed.

When all the print jobs are finished in S112, in S113, the print operation history collecting portion 506 stores the number of sheets used in the print job in the storage device 469.

In S114, the print operation history analyzing portion 508 acquires the latest print operation history from the storage device 469, calculates the average value of the number of continuously printed sheets, and stores the average value in the storage device 469.

As described above, in the present embodiment, a sheet count for determining whether to switch the image forming speed is changeable depending on a temperature in an environment in which the image forming apparatus is arranged. An image forming speed optimal for each environmental temperature is selected so that the print productivity can be maximized.

Embodiment 4

Configuration of Control Block

Figure 12:
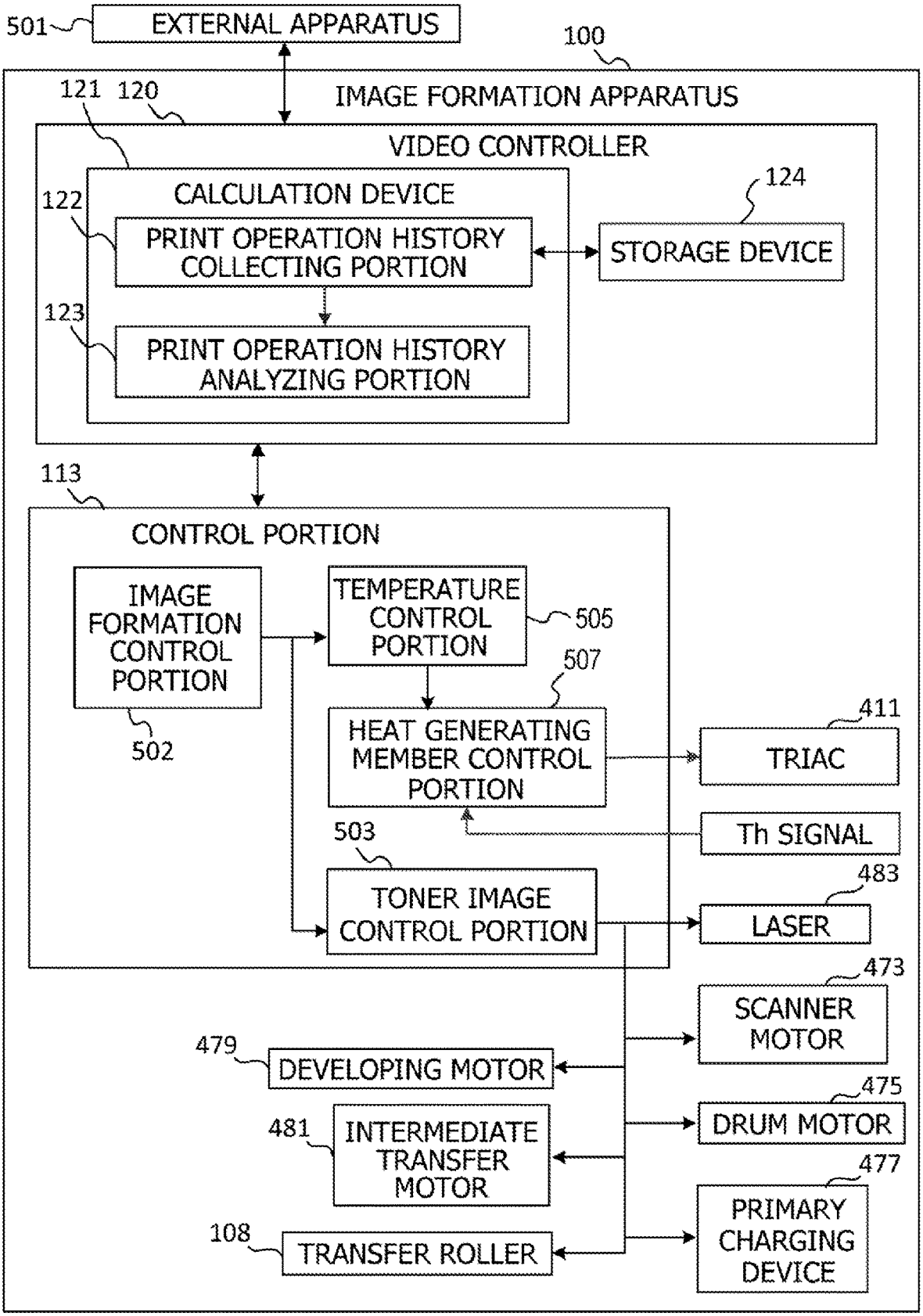
FIG. 12 is a control block diagram of Embodiment 4.

FIG. 12 is a control block diagram of the present embodiment. The video controller 120 stores and analyzes print operation histories. When receiving image information and a print instruction from the external apparatus 501, the video controller 120 instructs the control portion 113 to perform preparation operation. After that, the video controller 120 converts the image information into printable information, and instructs the control portion 113 to perform print operation (image forming operation). The control portion 113 starts print operation in response to the instruction from the video controller 120.

A print operation history collecting portion 122 stores print operation histories in a storage device (storage portion) 124. Further, as in Embodiment 1, processing until the end of the printing of all sheets is regarded as one job. The print operation history collecting portion 122 acquires, as a print operation history, information on how many sheets have been continuously printed per job and sheet size information, and stores the information in the storage device 124. Further, the print operation history collecting portion 122 may collect sheet size information, information on the number of continuously printed sheets, and user ID information for each print job, and store the information in the storage device 124. The print operation history collecting portion 122 may perform processing similar to the processing that is performed by the print operation history collecting portion 506, which is described in Embodiments 1 to 3.

A print operation history analyzing portion 123 stores print operation history analysis results in the storage device 124. The print operation history analyzing portion 123 calculates the average value of the number of continuously printed sheets per job in regard to each sheet size. Further, the result of calculation by the print operation history analyzing portion 123 is also stored in the storage device 124. The print operation history analyzing portion 123 may perform processing similar to the processing that is performed by the print operation history analyzing portion 508, which is described in Embodiments 1 to 3. The print operation history analyzing portion 123 may store, in the storage device 124, information stored in the storage device 469 described in Embodiments 1 to 3. Control method and throughput control method in image forming operation using print operation history analysis results in the present embodiment are similar to those of Embodiment 1, and a description thereof is thus omitted.

Embodiment 5

An image forming system according to the present embodiment is described.

Configuration of Control Blocks

Figure 13:
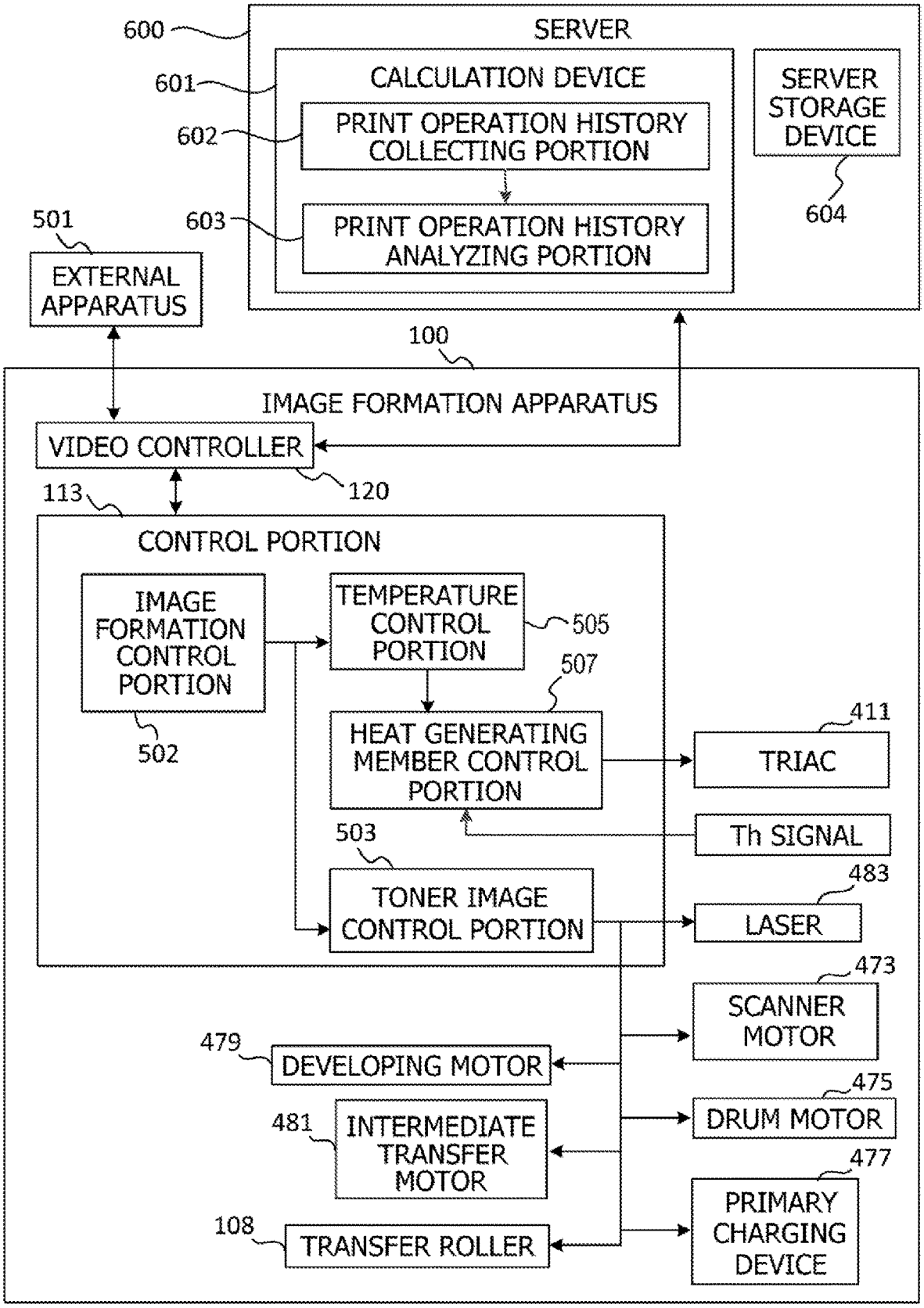
FIG. 13 is a control block diagram of Embodiment 5.

FIG. 13 is a control block diagram of the present embodiment. The image forming system includes the image forming apparatus 100 and a server 600. The server 600 stores and analyzes print operation histories. The server 600 includes a calculation device 601 and a server storage device 604, and is connected to the image forming apparatus 100 by a network that allows bidirectional access. When receiving image information and a print instruction from the external apparatus 501, the video controller 120 instructs the control portion 113 to perform preparation operation. After that, the video controller 120 converts the image information into printable information, and instructs the control portion 113 to perform print operation (image forming operation). The control portion 113 starts print operation in response to the instruction from the video controller 120.

A print operation history collecting portion 602 stores print operation histories in the server storage device (storage portion) 604. Further, as in Embodiment 1, processing until the end of the printing of all sheets is regarded as one job. The print operation history collecting portion 602 acquires, as a print operation history, information on how many sheets have been continuously printed per job and sheet size information, and stores the information in the server storage device 604. Further, the print operation history collecting portion 602 may collect sheet size information, information on the number of continuously printed sheets, and user ID information for each print job, and store the information in the server storage device 604. The print operation history collecting portion 602 may perform processing similar to the processing that is performed by the print operation history collecting portion 506, which is described in Embodiments 1 to 3.

A print operation history analyzing portion 603 stores print operation history analysis results in the server storage device 604. The print operation history analyzing portion 603 calculates the average value of the number of continuously printed sheets per job in regard to each sheet size. Further, the result of calculation by the print operation history analyzing portion 603 is also stored in the server storage device 604. The print operation history analyzing portion 603 may perform processing similar to the processing that is performed by the print operation history analyzing portion 508, which is described in Embodiments 1 to 3. The print operation history analyzing portion 603 may store, in the server storage device 604, information stored in the storage device 469 described in Embodiments 1 to 3. Control method and throughput control method in image forming operation using print operation history analysis results in the present embodiment are similar to those of Embodiment 1, and a description thereof is thus omitted.

The configurations of the embodiments described above can be combined to each other if possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2019-139599, filed on Jul. 30, 2019, and Japanese Patent Application No. 2020-107990, filed on Jun. 23, 2020, which are hereby incorporated by reference herein in their entirety.

What is claimed is:

1. An image forming apparatus, comprising:

an image forming portion configured to form an image on a sheet;

a fixing portion including a nip portion that nips and conveys the sheet, the fixing portion heating the image at the nip portion to fix the image onto the sheet;

a storage portion configured to store a print operation history relative to a number of sheets per print job of small-sized sheets each having a width smaller than that of a maximum-sized sheet having a maximum width in a direction orthogonal to a conveying direction of the sheet; and a control portion configured to control a conveying speed of the sheets in a print operation;

wherein, in a first case where the print operation is started in a state where the number of sheets per print job of the small-sized sheets to be used in the print operation is determined, the control portion sets the conveying speed in accordance with the determined number of sheets per print job of the small-sized sheets, wherein, in a second case where the print operation is started in a state where the number of sheets per print job of the small-sized sheets to be used in the print operation is not determined, the control portion sets the conveying speed in accordance with the print operation history stored in the storage portion, wherein, in the second case, when a representative value of the number of the sheets of the small-sized sheets per print job acquired from the history is smaller than a predetermined threshold, the control portion executes a first operating mode in which the conveying speed is controlled to a first speed, and in the second case, when the representative value is larger than the threshold, the control portion executes a second operating mode in which the conveying speed is controlled to a second speed lower than the first speed.

2. The image forming apparatus according to claim 1, further comprising a temperature detecting portion that detects a temperature of the fixing portion, wherein the control portion controls the fixing portion so that a temperature detected by the temperature detecting portion is kept at a predetermined target temperature, and wherein the target temperature of the second operation mode is lower than that of the first operation mode.

3. The image forming apparatus according to claim 1, wherein the control portion controls, in the first operating mode, a conveying interval between the sheets to be at a constant interval during the print job.

4. The image forming apparatus according to claim 1, wherein the representative value is any one of an average value, a median value, and a most frequent value of the number of the sheets for the print job.

5. The image forming apparatus according to claim 1, wherein the storage portion stores the history for each size of the sheets conveyable by the nip portion.

6. The image forming apparatus according to claim 1, wherein the image forming apparatus is connected to a plurality of external apparatuses via a network, and wherein the storage portion stores the history for each of the plurality of external apparatuses.

7. The image forming apparatus according to claim 1, further comprising an environmental information acquiring portion that acquires environmental information relating to an environment in which the image forming apparatus is arranged, wherein the threshold is set in accordance with the environmental information acquired by the environmental information acquiring portion.

8. The image forming apparatus according to claim 1, wherein the fixing portion comprises:

a heater unit including a heater and a holding member that holds the heater;

a tubular film having an inner surface that is in contact with the heater unit; and a pressure member that is in contact with an outer surface of the film and forms the nip portion between the pressure member and the outer surface together with the heater unit.

9. An image forming system, comprising:

an image forming apparatus including an image forming portion configured to form an image on a sheet, a fixing portion including a nip portion that nips and conveys the sheet, the fixing portion heating the image at the nip portion to fix the image onto the sheet, and a control portion configured to control a conveying speed of the sheets in a print operation; and a server connected to the image forming apparatus by a network that allows bidirectional access, and including a storage portion configured to store a print operation history relative to a number of sheets per print job of small-sized sheets each having a width smaller than that of a maximum-sized sheet having a maximum width in a direction orthogonal to a conveying direction of the sheet, wherein, in a first case where the print operation is started in a state where the number of sheets per print job of the small-sized sheets to be used in the print operation is determined, the control portion sets the conveying speed in accordance with the determined number of sheets per print job of the small-sized sheets, wherein, in a second case where the print operation is started in a state where the number of sheets per print job of the small-sized sheets to be used in the print operation is not determined, the control portion sets the conveying speed in accordance with the print operation history stored in the storage portion, wherein, in the second case, when a representative value of the number of the sheets of the small-sized sheets per print job acquired from the history is smaller than a predetermined threshold, the control portion executes a first operating mode in which the conveying speed is controlled to a first speed, and in the second case, when the representative value is larger than the threshold, the control portion executes a second operating mode in which the conveying speed is controlled to a second speed lower than the first speed.

10. The image forming system according to claim 9, wherein the image forming apparatus further comprises a temperature detecting portion that detects a temperature of the fixing portion, and wherein the control portion controls so that a temperature detected by the temperature detecting portion is kept at a predetermined target temperature, and wherein the target temperature of the second operation mode is lower than that of the first operation mode.

11. The image forming system according to claim 9, wherein the control portion controls, in the first operating mode, a conveying interval between the sheets to be at a constant interval during the print job.

12. The image forming system according to claim 9, wherein the representative value is any one of an average value, a median value, and a most frequent value of the number of the sheets for the print job.

13. The image forming system according to claim 9, wherein the storage portion stores the history for each size of the sheets conveyable by the nip portion.

14. The image forming system according to claim 9, wherein the image forming apparatus is connected to a plurality of external apparatuses via a network, and wherein the storage portion stores the history for each of the plurality of external apparatuses.

15. The image forming system according to claim 9, wherein the image forming apparatus further comprises an environmental information acquiring portion configured to acquire environmental information relating to an environment in which the image forming apparatus is installed, and wherein the threshold is set in accordance with the environmental information acquired by the environmental information acquiring portion.

16. The image forming system according to claim 9, wherein the fixing portion comprises:

a heater unit including a heater and a holding member that holds the heater;

a tubular film having an inner surface that is in contact with the heater unit; and a pressure member that is in contact with an outer surface of the film and forms the nip portion between the pressure member and the outer surface together with the heater unit.

17. An image forming apparatus, comprising:

an image forming portion configured to form an image on a sheet;

a fixing portion including a nip portion that nips and conveys the sheet, the fixing portion heating the image at the nip portion to fix the image onto the sheet;

a storage portion configured to store a print operation history relative to a number of sheets per print job of small-sized sheets each having width smaller than that of a maximum-sized sheet having a maximum width in a direction orthogonal to a conveying direction of the sheet; and a control portion configured to control a throughput of a print operation, wherein, in a first case where the print operation is started in a state where the number of sheets per print job of the small-sized sheets to be used in the print operation is determined, the control portion sets the throughput in accordance with the determined number of sheets per print job of the small-sized sheets, and wherein, in a second case where the print operation is started in a state where the number of sheets per print job of the small-sized sheets to be used in the print operation is not determined, the control portion sets the throughput in accordance with the print operation history stored in the storage portion.

18. The image forming apparatus according to claim 17, wherein, in the second case, when a representative value of the number of the sheets of the small-sized sheets per print job acquired from the history is smaller than a predetermined threshold, the control portion executes a first operating mode in which the throughput is controlled to a first throughput, and in the second case, when the representative value is larger than the threshold, the control portion executes a second operating mode in which the throughput is controlled to a second throughput lower than the first throughput.

19. The image forming apparatus according to claim 17, wherein the storage portion stores the history for each size of the sheets conveyable by the nip portion.

20. The image forming apparatus according to claim 17, wherein the image forming apparatus is connected to a plurality of external apparatuses via a network, and wherein the storage portion stores the history for each of the plurality of external apparatuses.

21. The image forming apparatus according to claim 17, further comprising an environmental information acquiring portion that acquires environmental information relating to an environment in which the image forming apparatus is arranged, wherein the threshold is set in accordance with the environmental information acquired by the environmental information acquiring portion.

22. The image forming apparatus according to claim 17, wherein the fixing portion comprises:

a heater unit including a heater and a holding member that holds the heater;

a tubular film having an inner surface that is in contact with the heater unit; and a pressure member that is in contact with an outer surface of the film and forms the nip portion between the pressure member and the outer surface together with the heater.

23. An image forming system, comprising:

an image forming apparatus including an image forming portion configured to form an image on a sheet, a fixing portion including a nip portion that nips and conveys the sheet, the fixing portion heating the image at the nip portion to fix the image onto the sheet, and a control portion configured to control a throughput of a print operation; and a server connected to the image forming apparatus by a network that allows bidirectional access, and including a storage portion configured to store a print operation history relative to a number of sheets per print job of small-sized sheets each having width smaller than that of a maximum-sized sheet having a maximum width in a direction orthogonal to a conveying direction of the sheet, wherein, in a first case where the print operation is started in a state where the number of sheets per print job of the small-sized sheets to be used in the print operation is determined, the control portion sets the throughput in accordance with the determined number of sheets per print job of the small-sized sheets, wherein, in a second case where the print operation is started in a state where the number of sheets per print job of the small-sized sheets to be used in the print operation is not determined, the control portion sets the throughput in accordance with the print operation history stored in the storage portion.

24. The image forming system according to claim 23, wherein, in the second case, when a representative value of the number of the sheets of the small-sized sheets per print job acquired from the history is smaller than a predetermined threshold, the control portion executes a first operating mode in which the throughput is controlled to a first throughput, and in the second case, when the representative value is larger than the threshold, the control portion executes a second operating mode in which the throughput is controlled to a second throughput lower than the first throughput.

25. The image forming system according to claim 23, wherein the storage portion stores the history for each size of the sheets conveyable by the nip portion.

26. The image forming system according to claim 23, wherein the image forming apparatus is connected to a plurality of external apparatuses via a network, and wherein the storage portion stores the history for each of the plurality of external apparatuses.

27. The image forming system according to claim 23, further comprising an environmental information acquiring portion that acquires environmental information relating to an environment in which the image forming apparatus is arranged, wherein the threshold is set in accordance with the environmental information acquired by the environmental information acquiring portion.

28. The image forming system according to claim 23, wherein the fixing portion comprises:

a heater unit including a heater and a holding member that holds the heater;

a tubular film having an inner surface that is in contact with the heater unit; and a pressure member that is in contact with an outer surface of the film and forms the nip portion between the pressure member and the outer surface together with the heater.

* * * * *